US010591253B1

(12) United States Patent
Webber

(10) Patent No.: US 10,591,253 B1
(45) Date of Patent: Mar. 17, 2020

(54) FINGER-ADJUSTABLE SCOPE ADJUSTMENT MECHANISM

(71) Applicant: TANGENT THETA INC., Halifax (CA)

(72) Inventor: Andrew S. Webber, Halifax (CA)

(73) Assignee: Tangent Theta Inc., Halifax (CA)

( * ) Notice: Subject to any disclaimer, the term of this patent is extended or adjusted under 35 U.S.C. 154(b) by 309 days.

(21) Appl. No.: 14/214,312

(22) Filed: Mar. 14, 2014

Related U.S. Application Data

(60) Provisional application No. 61/801,676, filed on Mar. 15, 2013.

(51) Int. Cl.
*F41G 1/54* (2006.01)
*G05G 1/10* (2006.01)

(52) U.S. Cl.
CPC ..... *F41G 1/545* (2013.01); *G05G 1/10* (2013.01)

(58) Field of Classification Search
CPC ..... G02B 23/14; G02B 27/34; G02B 27/32; G02B 23/12; G02B 23/10; G02B 23/00; G02B 23/145; G02B 27/36; G02B 7/10; G02B 19/0028; G02B 19/0061; G02B 23/02; G02B 23/08; G02B 23/16; G02B 23/18; G02B 27/0006; G02B 27/30; F41G 1/38; F41G 1/345; F41G 1/383; F41G 11/001; F41G 11/003; F41G 1/30; F41G 1/40; F41G 1/44
See application file for complete search history.

(56) References Cited

U.S. PATENT DOCUMENTS

| | | | | |
|---|---|---|---|---|
| 4,247,161 | A | 1/1981 | Unertl, Jr. | |
| 4,643,542 | A | 2/1987 | Gibson | |
| 5,261,758 | A * | 11/1993 | Vranish | B23B 31/113 403/13 |
| 6,279,259 | B1 | 8/2001 | Otteman | |
| 6,519,890 | B1 | 2/2003 | Otteman | |
| 6,643,970 | B2 | 11/2003 | Huber | |
| 6,691,447 | B1 | 2/2004 | Otteman | |
| 6,772,550 | B1 | 8/2004 | Leatherwood | |
| 7,415,791 | B2 | 8/2008 | Williams, III et al. | |
| 7,578,091 | B2 | 8/2009 | Klepp et al. | |
| 7,581,346 | B2 | 9/2009 | Klepp et al. | |
| 7,612,952 | B2 | 11/2009 | Schafer | |
| 7,626,760 | B2 | 12/2009 | Wu | |
| 7,640,830 | B2 | 1/2010 | Bonis | |
| 7,934,335 | B2 | 5/2011 | Halverson | |
| 7,937,879 | B2 | 5/2011 | Hamilton | |
| 7,958,665 | B2 | 6/2011 | Hamilton | |

(Continued)

*Primary Examiner* — William R Alexander
*Assistant Examiner* — Sharrief I Broome
(74) *Attorney, Agent, or Firm* — Fish & Richardson P.C.

(57) ABSTRACT

The present disclosure describes an adjustment mechanism for a scope comprising: a first surface and a second surface, the first surface configured to engage the second surface axially when an amount of force is applied to the first surface, the first surface also configured to transfer torque applied to it to the second surface when the first surface and the second surface are engaged, and a member adjustable to apply force to the first surface to engage the first surface and the second surface, the member being adjustable using only one or more human fingers, wherein an adjustment of the member can always be initiated using only one or more human fingers.

11 Claims, 25 Drawing Sheets

CONICAL SPLINE METHOD OF TRANSMITTING TORQUE SHOWN IN THE DISENGAGED POSITION. NOTE SPLINE DISENGAGEMENT AT POSITION 'A'.

(56) References Cited

U.S. PATENT DOCUMENTS

| | | | | |
|---|---|---|---|---|
| 7,997,163 | B2 | 8/2011 | Casas | |
| 8,006,429 | B2 | 8/2011 | Windauer | |
| 8,312,667 | B2 | 11/2012 | Thomas et al. | |
| 2003/0140545 | A1 | 7/2003 | Huber | |
| 2006/0254115 | A1* | 11/2006 | Thomas | F41G 1/38 42/122 |
| 2007/0137089 | A1 | 6/2007 | William et al. | |
| 2007/0240356 | A1 | 10/2007 | Klepp et al. | |
| 2008/0066364 | A1 | 3/2008 | Klepp et al. | |
| 2008/0236018 | A1 | 10/2008 | Halverson | |
| 2008/0289239 | A1* | 11/2008 | Menges | F41G 1/38 42/125 |
| 2009/0205461 | A1* | 8/2009 | Windauer | F41G 1/38 74/553 |
| 2009/0241399 | A1 | 10/2009 | Hamilton | |
| 2010/0175298 | A1* | 7/2010 | Thomas | F41G 1/18 42/122 |
| 2010/0229451 | A1 | 9/2010 | Hamilton | |
| 2011/0061285 | A1 | 3/2011 | Hamilton | |
| 2012/0144719 | A1* | 6/2012 | Huber | F41G 1/38 42/122 |
| 2012/0167444 | A1* | 7/2012 | Adkins | F41G 1/38 42/135 |
| 2013/0160344 | A1 | 6/2013 | Thomas et al. | |

* cited by examiner

300b

300c

Female Conical Spline

Male Conical Spline

CONICAL SPLINE METHOD OF TRANSMITTING TORQUE SHOWN IN THE ENGAGED POSITION. NOTE SPLINE ENGAGEMENT AT POSITION 'A'.

CONICAL SPLINE METHOD OF TRANSMITTING TORQUE SHOWN IN THE DISENGAGED POSITION.
NOTE SPLINE DISENGAGEMENT AT POSITION 'A'.

CONICAL TAPER METHOD OF TRANSMITTING TORQUE SHOWN IN THE ENGAGED POSITION. NOTE SURFACE ENGAGEMENT AT POSITION 'B'.

CONICAL TAPER METHOD OF TRANSMITTING TORQUE SHOWN IN THE DISENGAGED POSITION.
NOTE SURFACE DISENGAGEMENT AT POSITION 'B'.

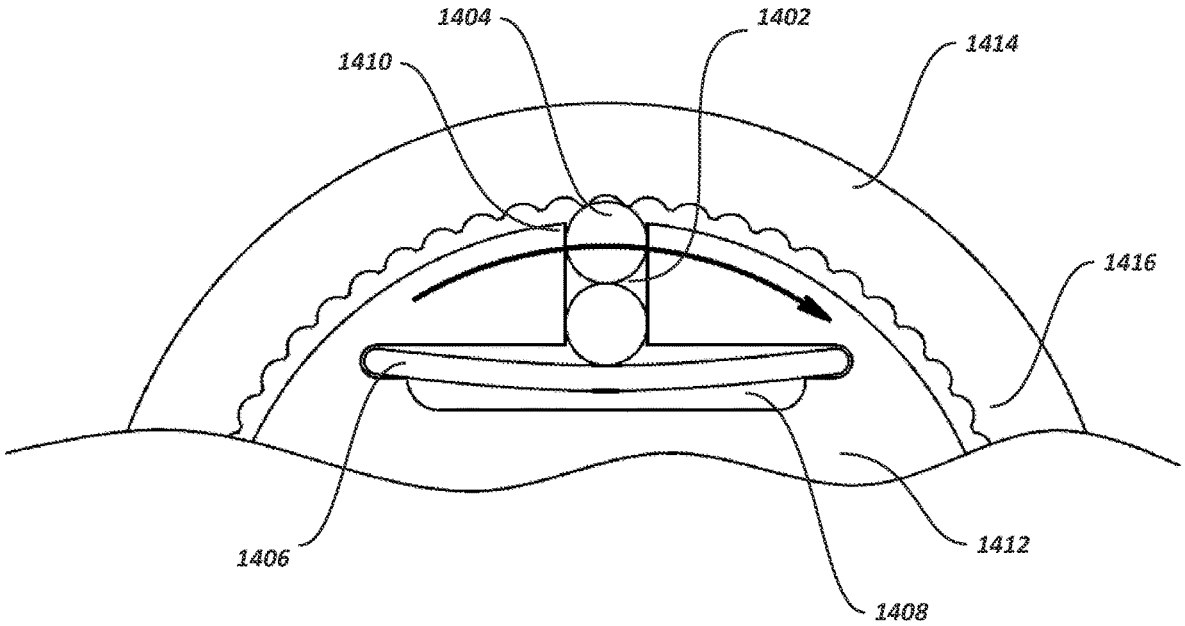
FIG. 14A
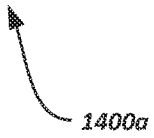

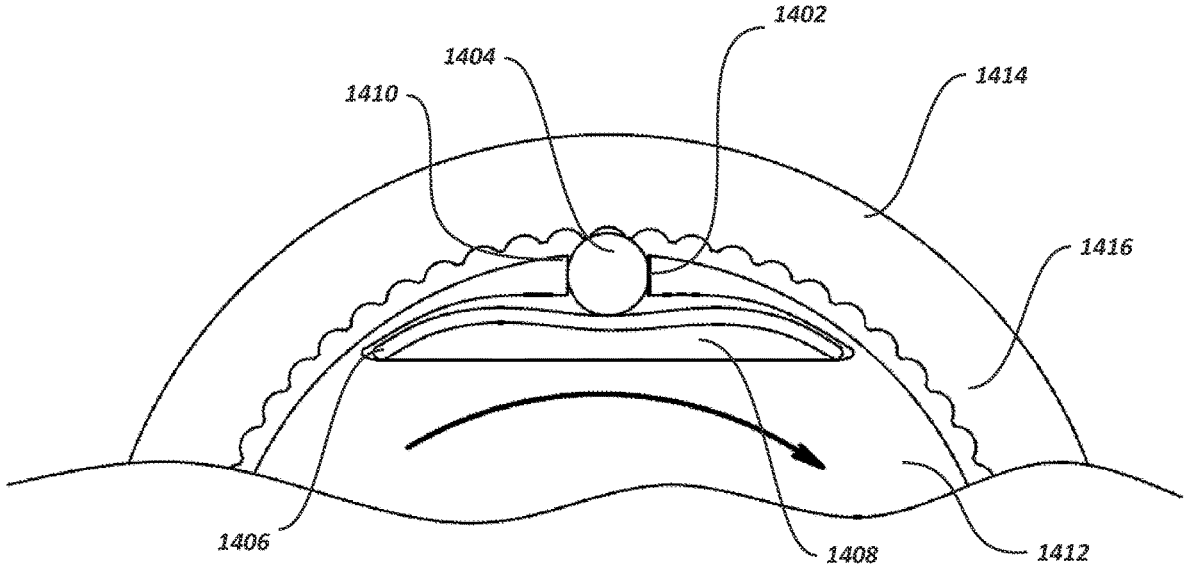
FIG. 14B
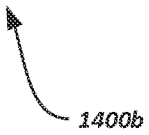

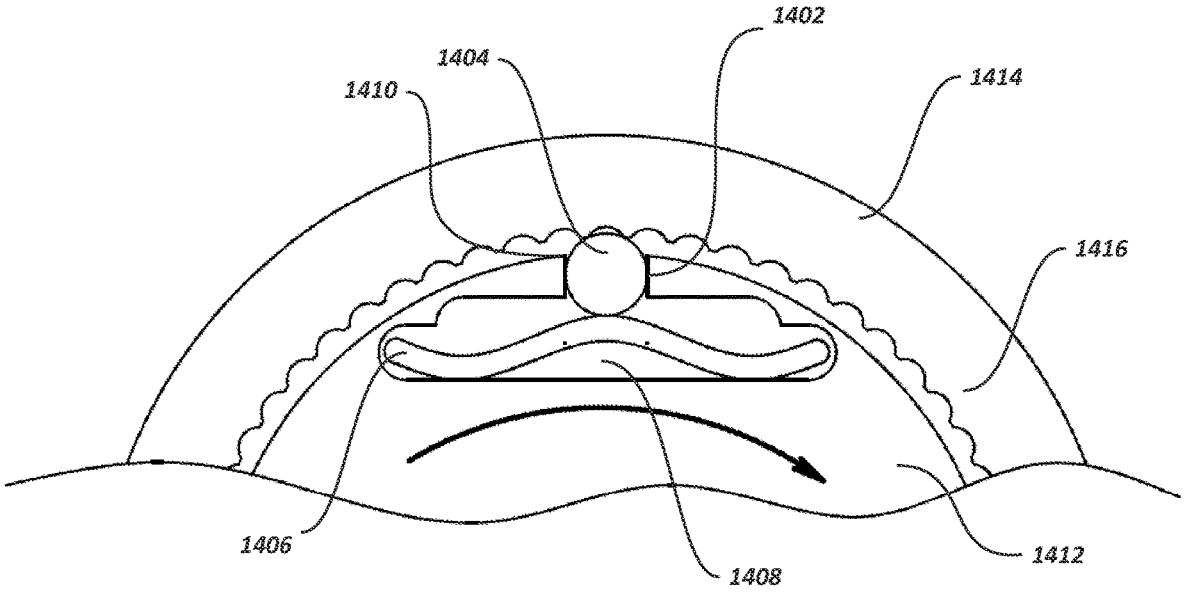
FIG. 14C
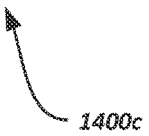

1400d

FINGER-ADJUSTABLE SCOPE ADJUSTMENT MECHANISM

CROSS-REFERENCE TO RELATED APPLICATIONS

This application is a non-provisional application of and claims the benefit of priority to U.S. Provisional Application Ser. No. 61/801,676, filed on Mar. 15, 2013, and entitled "Finger-Adjustable Scope Adjustment Mechanism", the contents of which are hereby incorporated by reference.

BACKGROUND

Optical scopes, such as rifle scopes, and other optical sighting systems are typically equipped with at least one adjustment mechanism such that a shooter can accommodate for various conditions that can cause the point-of-impact of a fired bullet to vary compared to an originally set point-of-aim, such as the ballistic properties of a bullet, environmental conditions (altitude, humidity, wind, etc.), and the distance to the target. Adjustment mechanisms may provide movement of the reticle with respect to the image that is created by the objective system (e.g., first focal plane) or the objective and the erector system (e.g., second focal plane). Knowing or estimating the environmental conditions and other factors influencing the point-of-impact, the shooter can adjust the reticle position so that the expected point-of-impact will be coincidental with a chosen feature within the reticle.

SUMMARY

The present disclosure relates to optical scopes, such as such as rifle scopes, and other optical sighting systems, and adjustment mechanisms for rifled scopes and other optical sighting systems.

In a first implementation, an adjustment mechanism for a scope comprises a first surface and a second surface, the first surface configured to engage the second surface axially when an amount of force is applied to the first surface, the first surface also configured to transfer torque applied to it to the second surface when the first surface and the second surface are engaged; and a member adjustable to apply force to the first surface to engage the first surface and the second surface, the member being adjustable using only one or more human fingers, wherein an adjustment of the member can always be initiated using only one or more human fingers.

The first implementation can optionally include one or more of the following features, alone or in combination:

A first aspect, combinable with the first implementation, wherein the member is one of a fluted knob, a knurled knob, a wing nut, a set screw, and/or some other type of feature that can be actuated with one or more human fingers.

A second aspect, combinable with first implementation, wherein the member is rotatable in a first direction causing it to exert more force on the first surface, and rotatable in a second direction opposite from the first direction causing it to exert less force on the first surface. A third aspect, combinable with first implementation, wherein the first surface is a male conical spline and the second surface is a female conical spline.

A fourth aspect, combinable with first implementation, wherein the first surface and the second surface are high friction surfaces, and the member transmits axial force directly as a result of actuation by one or more human fingers to the first surface causing the first surface to engage the second surface.

A fifth aspect, combinable with first implementation, wherein the interaction of the first and second surfaces provides movement of a reticle with respect to an image that is created by the scope.

In a second implementation, a scope adjustment mechanism comprises an adjustment knob including a finger-adjustable axial screw and a first surface actuated by the finger-adjustable axial screw; and an erector tube actuation mechanism including a second surface, wherein the first surface and the second surface are configured to engage one another to transmit rotational torque when the finger-adjustable screw is tightened, and configured to disengage one another to not transmit rotational torque when the finger-adjustable screw is loosened, and wherein the finger-adjustable screw is configured to always allow initiation of a loosening of the finger-adjustable screw by one or more human fingers.

The second implementation can optionally include one or more of the following features, alone or in combination:

A first aspect, combinable with the second implementation, wherein the first and second surfaces are plates.

A second aspect, combinable with second implementation, wherein the first and second surfaces are splines.

A third aspect, combinable with second implementation, wherein the first and second surfaces are tapers.

A fourth aspect, combinable with second implementation, wherein the first and second surfaces are cones.

A fifth aspect, combinable with second implementation, wherein the adjustment knob rotates freely when the finger-adjustable screw is loosened.

A sixth aspect, combinable with second implementation, wherein the finger-adjustable screw includes a finger-adjustable feature including at least one of: a knurled head, a fluted head, a wing-nut, and/or some other type of feature that can be actuated with one or more human fingers.

A seventh aspect, combinable with second implementation, wherein the finger-adjustable screw may be adjusted without using a tool.

In a third implementation, a scope comprises a tube; an objective system; an ocular system; and an erector system comprising an adjustment mechanism connected to the tube such that the adjustment mechanism provides movement of a reticle with respect to an image that is created by the objective system, the adjustment mechanism including: a first surface and a second surface, the first surface configured to engage the second surface axially when an amount of force is applied to the first surface, the first surface also configured to transfer torque applied to it to the second surface when the first surface and the second surface are engaged; and a member adjustable to apply force to the first surface to engage the first surface and the second surface, the member being adjustable using only one or more human fingers.

The third implementation can optionally include one or more of the following features, alone or in combination:

A first aspect, combinable with the third implementation, wherein the member is one of a fluted knob, a knurled knob, a wing nut, a set screw, and/or some other type of feature that can be actuated with one or more human fingers.

A second aspect, combinable with third implementation, wherein the member is rotatable in a first direction causing it to exert more force on the first surface, and rotatable in a second direction opposite from the first direction causing it to exert less force on the first surface.

A third aspect, combinable with third implementation, wherein the first surface is a male conical spline and the second surface is a female conical spline.

A fourth aspect, combinable with third implementation, wherein the first surface and the second surface are high friction surfaces, and the member transmits axial force directly from the one or more human fingers to the first surface causing the first surface to engage the second surface.

In a fourth implementation, a scope comprises: a tube; an objective system; an ocular system; and an erector system comprising an adjustment mechanism connected to the tube such that the adjustment mechanism provides movement of a reticle with respect to an image that is created by the objective system, the adjustment mechanism including: an adjustment knob including a finger-adjustable axial screw and a first surface coupled to the finger-adjustable axial screw; and an erector tube actuation mechanism including a second surface, wherein the first surface and the second surface are configured to engage one another to transmit rotational torque when the finger-adjustable screw is tightened, and configured to disengage one another to not transmit rotational torque when the finger-adjustable screw is loosened, wherein an adjustment of the member can always be initiated using only one or more human fingers, and wherein the finger-adjustable screw is configured to always allow initiation of a loosening of the finger-adjustable screw by one or more human fingers.

The fourth implementation can optionally include one or more of the following features, alone or in combination:

A first aspect, combinable with the fourth implementation, wherein the first and second surfaces are plates.

A second aspect, combinable with fourth implementation, wherein the first and second surfaces are splines.

A third aspect, combinable with fourth implementation, wherein the first and second surfaces are tapers.

A fourth aspect, combinable with fourth implementation, wherein the first and second surfaces are cones.

A fifth aspect, combinable with fourth implementation, wherein the adjustment knob rotates freely when the finger-adjustable screw is loosened.

A sixth aspect, combinable with fourth implementation, wherein the finger-adjustable screw includes a finger-adjustable feature including at least one of: a knurled head, a fluted head, a wing-nut, and/or some other type of feature that can be actuated with one or more human fingers.

A seventh aspect, combinable with fourth implementation, wherein the finger-adjustable screw may be adjusted without using a tool.

The details of one or more implementations of the subject matter of this specification are set forth in the accompanying drawings and the description below. Other features, aspects, and advantages of the subject matter will become apparent from the description, the drawings, and the claims.

DESCRIPTION OF DRAWINGS

FIGS. 14A-14D illustrate cross-sectional views of alternate detent assemblies to provide auditory/tactile feedback during optical scope adjustment according to an implementation.

Like reference numbers and designations in the various drawings indicate like elements.

DETAILED DESCRIPTION

Figure 1:
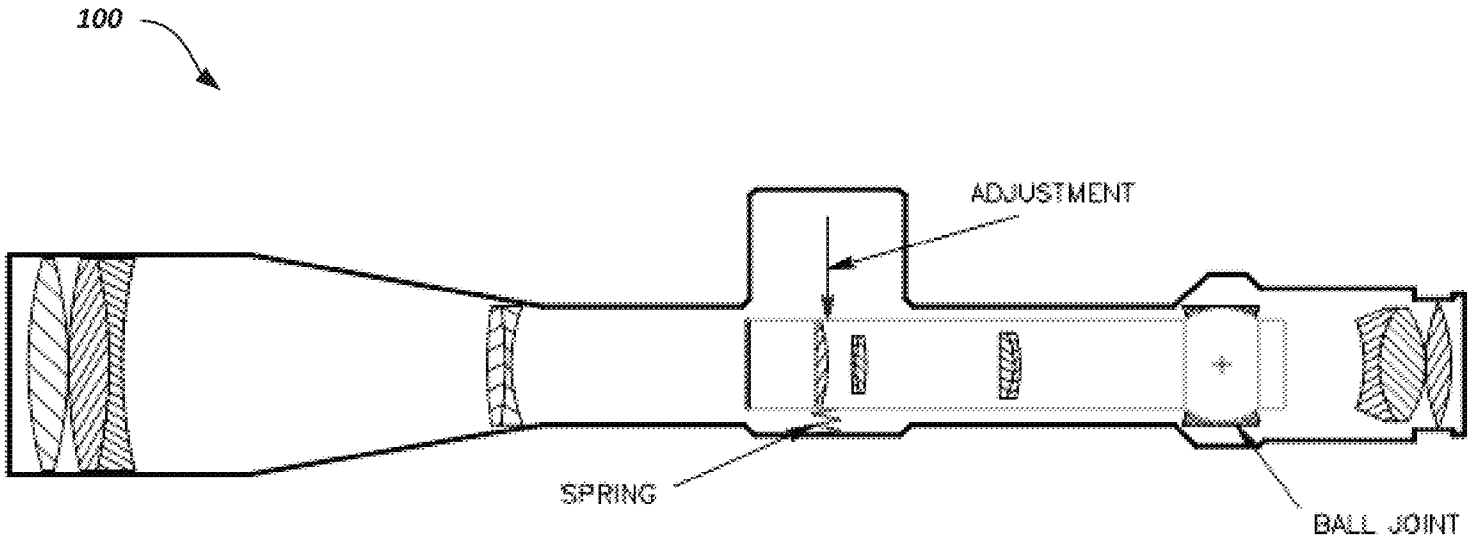
FIG. 1 is an illustration of an example optical scope according to an implementation.

At a high level, this disclosure describes an optical scope and scope adjustment mechanism. The following description is presented to enable any person skilled in the art to make and use the disclosed subject matter, and is provided in the context of one or more particular implementations. Various modifications to the disclosed implementations will be readily apparent to those skilled in the art, and the general principles defined herein may be applied to other implementations and applications without departing from scope of the disclosure. Thus, the present disclosure is not intended to be limited to the described and/or illustrated implementations, but is to be accorded the widest scope consistent with the principles and features disclosed herein.

The optical scope may include a tube, an objective system, an ocular system, and an erector system wherein the erector system may further include an adjustment mechanism system rotatably connected to the tube such that the adjustment mechanism system provides movement of a reticle with respect to an image that is created by the objective system, and wherein the adjustment mechanism system may include a saddle mechanism, an adjustment knob mechanism, and a finger-adjustable screw. In some implementations, the finger-adjustable screw may include a knurled head, a fluted head, or a wing-nut or some other type of feature that can be actuated with one or more human fingers allowing it to be adjusted using fingers only without the need for special, general, ad-hoc, or any other kind of tool. Generally, the adjustment knob applies pressure to and/or transfers torque the erector tube actuation mechanism when the finger-adjustable screw is tightened.

An optical scope may include a main tube, the housing that holds the optical system, which again may include an objective system, an ocular (or eyepiece) system, and an erector system. The erector system might be a system with fixed magnification or a system with variable magnification (zoom). A reticle is placed either at the front end (first focal plane or objective focal plane) or/and at the back end (second focal plane or ocular focal plane) of the erector system. This reticle is the aiming reference for the optical scope user such that, when the optical scope is, for example, properly adjusted on a firearm, a point-of-impact should be coincidental with an aiming reference point on the reticle chosen by the user.

Because of the ballistic properties of a projectile; environmental conditions such as altitude, humidity, wind, etc.; and the distance to the target, the point-of-impact can vary compared to the originally set reference point within the reticle. To allow the shooter to accommodate for these changing conditions, the scope is equipped with at least one (usually two) adjustment mechanisms. Each adjustment mechanism may be mounted to the main tube, usually one horizontally and another one vertically, so that the center axes of the two adjustment mechanisms make an angle of approximately 90°. The adjustment mechanisms impinge upon the erector system. When the adjustment mechanisms are used, they provide a movement of the reticle with respect to the image that is created by the objective system (first focal plane) or the objective and the erector system (second focal plane). Knowing or estimating the environmental conditions and other factors influencing the point-of-impact, the shooter can adjust the reticle position so that the expected point-of-impact will be coincidental with the chosen reticle feature again.

In some implementations, a method of transmitting torque through optical scope zeroing and or ballistic adjustment mechanisms by means of a friction or splined coupling in which no tools are required to engage or disengage the torque coupling is described. The method of transmitting torque may be engaged or disengaged by means of a finger-adjustable axial screw that engages a plate, spline, taper or cone that is attached to the calibrated adjustment knob with a corresponding plate, spline, taper or cone that is attached to the erector tube actuation mechanism. When the finger-adjustable screw is tightened, the plates, splines, tapers or cones of the knob assembly and the corresponding plates, splines, tapers or cones of the erector tube actuation mechanism engage one another sufficiently to transmit rotational torque applied to the knob through to the erector tube actuation system. Torque may be transmitted through the meshing of splines; either beveled, conical cylindrical or flat, or through the engagement of high-friction surfaces. When the finger-adjustable screw is loosened, the plates, splines, tapers, cylinders or cones of the knob assembly and the corresponding plates, splines, tapers, cylinders or cones of the erector tube actuation mechanism may disengage axially, either manually or by means of a spring or springs or by a another mechanical feature actuated by the finger-adjustable screw. The result is that the adjustment knob of the telescope may then rotate freely for the purpose of zeroing, re-zeroing or re-setting the calibrations on the knob to align with the index mark on the adjustment mechanism at any desired rotational position. The finger-adjustable aspect of the screw can be in the form of a knurled or fluted head, wing-nut, or other type of mechanical shape that allows the screw to be rotated by the finger pressure only and that does not require the assistance of tools of any kind, whether they be of special form, generic or ad-hoc (such as in the case of a coin or cartridge casing).

The foregoing examples and example advantages may not be present in every configuration or for every technique. While generally described as a scope, some or all of these aspects may be further included in respective systems, components or other devices for configuring, implementing, or otherwise resulting in a suitable system or device. The details of these and other aspects and embodiments of the present disclosure are set forth in the accompanying drawings and the description below. But other features, objects, and advantages of the preferred embodiment will be apparent from the description and drawings. Functions and embodiments described before can work alone or combined in any suitable way. Some of the above and below features are described in commonly owned U.S. patent application Ser. No. 12/684,585 entitled "Lockable Adjustment Mechanism," filed Jan. 8, 2010, the entire contents of which are incorporated by reference herein.

FIG. 1 is an illustration of an example optical scope 100 according to an implementation. In some implementations, "zeroing" or "re-zeroing" adjustment operations of the optical scope 100 is performed to align some feature on the reticle or cross-hair to match, for example, a rifle's point-of-impact at some chosen distance to a target.

Figure 2:
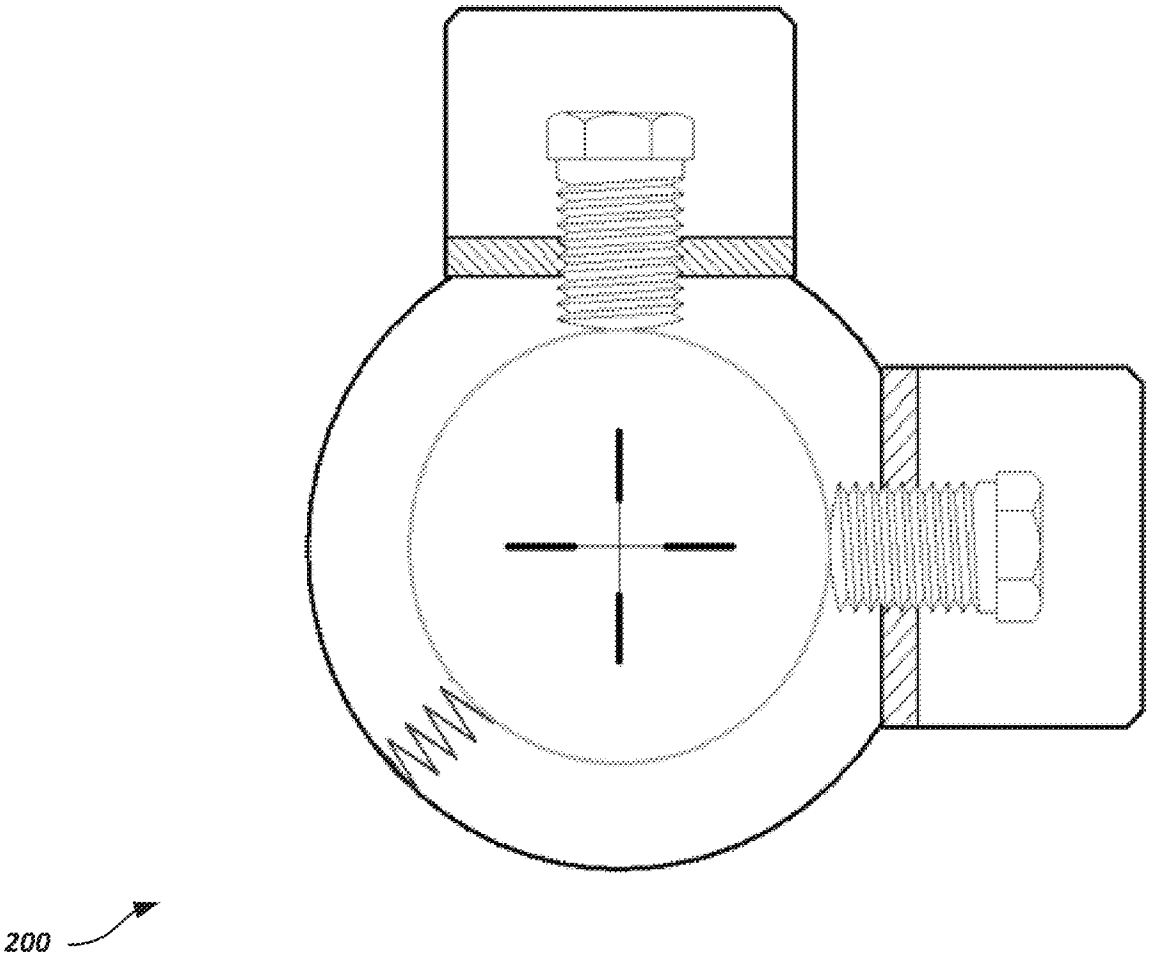
FIG. 2 is a rear cross-sectional view of an actuator screw mechanism according to an implementation.

FIG. 2 is a rear cross-sectional view 200 of an actuator screw mechanism 200 according to an implementation. In some implementations, adjustment of the optical scope 100 may be performed by rotating an actuator screw mechanism that in turn moves the internal erector tube mechanism. In some implementations, there are two adjustment/actuator mechanisms mounted to the telescope tube assembly and that which actuate the erector tube mechanism vertically and or horizontally, resulting in elevation an azimuth (windage) changes to the point-of-impact with respect to the point-of-aim. Typically the actuator mechanisms push the erector tube against a spring or springs that in turn push the erector tube back when the actuator mechanism is reversed.

Figure 3A:
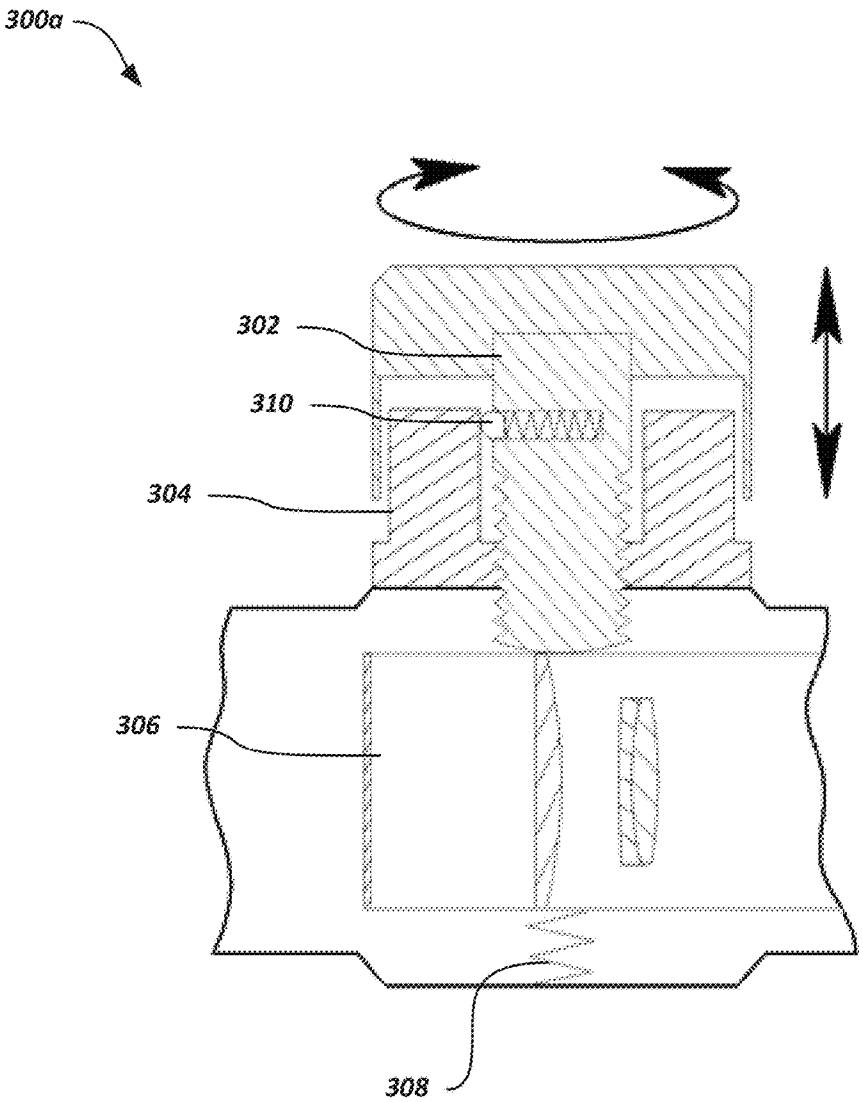
FIG. 3A is a side cross-sectional view of a scope adjustment mechanism according to an implementation.
Figure 3B:
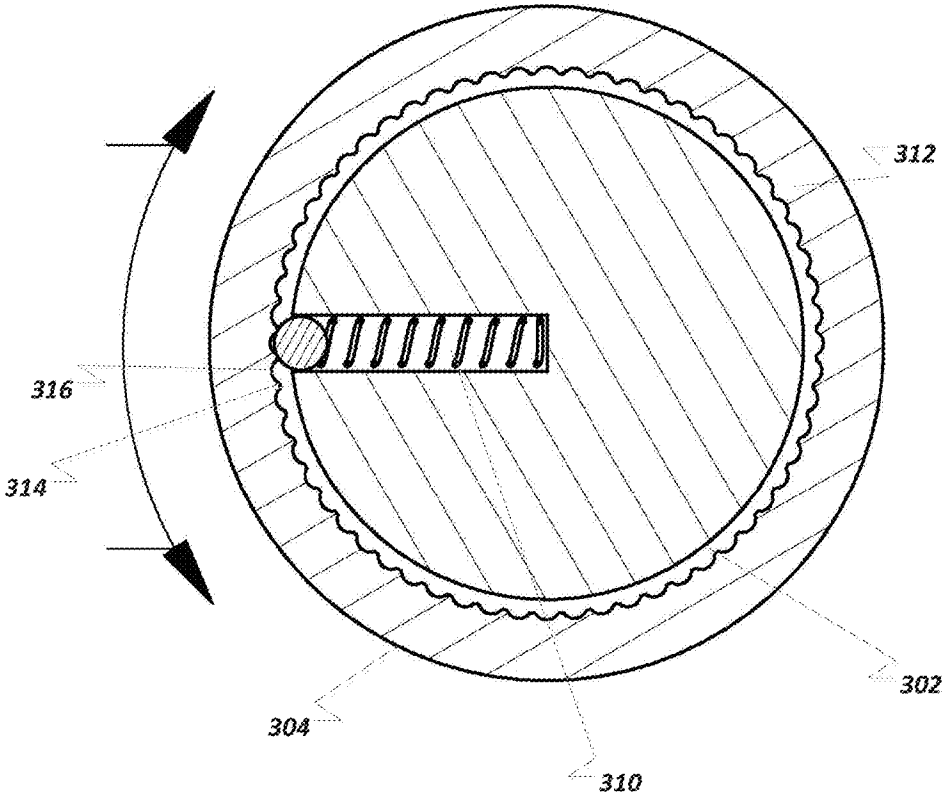
FIG. 3B is a cross sectional view of a detent assembly engaging a grooved surface according to an implementation.
Figure 3C:
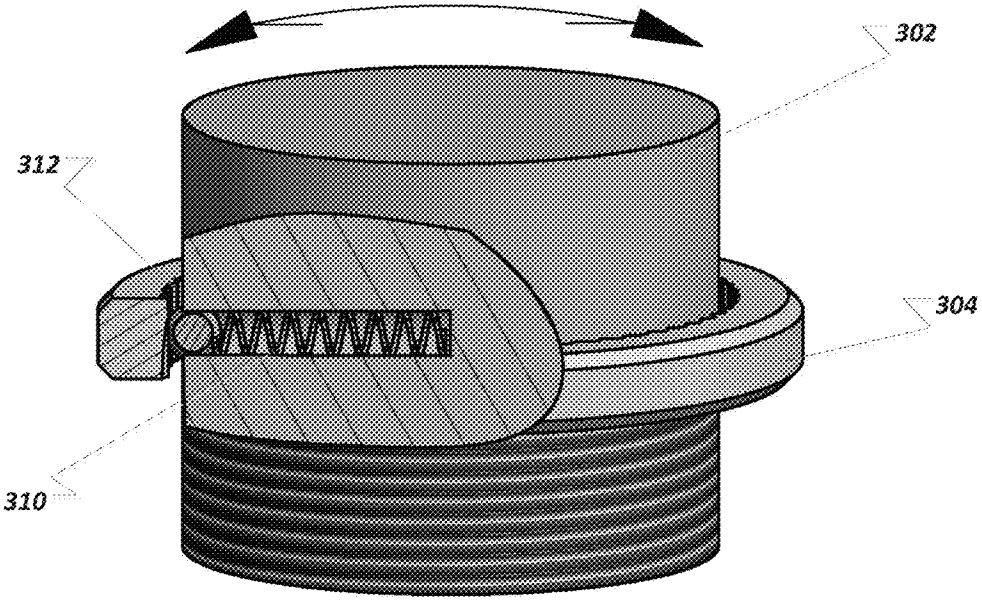
FIG. 3C is a cut-away side perspective view of a scope adjustment mechanism of FIGS. 3A and 3B illustrating the detent assembly engaging a grooved surface according to an implementation.
Figure 4:
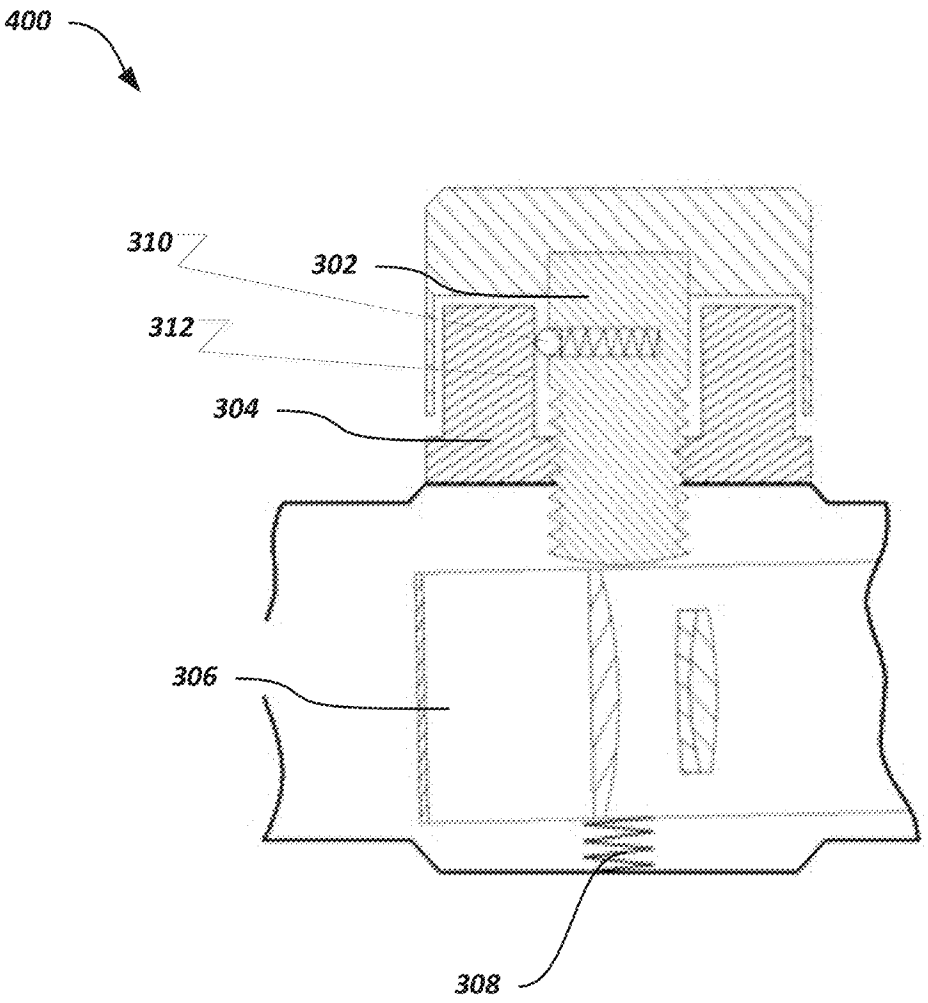
FIG. 4 is a side cross-sectional view of a scope adjustment mechanism according to an implementation.

FIG. 3A is a side cross-sectional view of a scope adjustment mechanism 300*a* according to an implementation. The scope adjustment mechanism 300 actuates the erector tube as described relative to FIG. 2. The scope adjustment mechanism 300 includes two mating threaded components 302 and 304; one free to rotate (302) and the other restricted from rotating (304) such that that when the threaded component 302 is turned, an axial translation results. The axial translation of the threaded component 304 moves the erector tube assembly 306 to change the point-of-impact of a projectile with respect to the point-of-aim of the optical scope. In some implementations, the adjustment mechanism 300*a* pushes the erector tube against spring or springs 308 that in turn push the erector tube back when the adjustment mechanism 300*a* is reversed (as shown in FIG. 4, where FIG. 4 is a side cross-sectional view 400 of the scope adjustment mechanism 300*a* of FIG. 3A according to an implementation). FIG. 3C is a cut-away side perspective view of a scope adjustment mechanism of FIGS. 3A and 3B illustrating the detent assembly 310 engaging a grooved surface 312 according to an implementation.

In some implementations, detent assembly 310 provides auditory/tactile feedback as threaded component 302 is rotated in relation to mated threading component 304. For example, the detent assembly 310 can be configured into threaded component 302 and, as illustrated, can include a detent element (e.g., a spherical ball bearing (illustrated) or other detent element) springily biased by a spring (e.g., a coil spring) toward inner surface 312 of mated threaded component 304. In some implementations, as illustrated in FIG. 3B, inner surface 312 of threaded component 304 can be configured with teeth, serrations, etc. (e.g., a toothed or splined structure) ("teeth") running parallel to the axis of threaded component 302. In some implementations, the teeth can be configured around part of or the entire interior surface of threaded component 304. As the threaded component 302 is rotated and the detent element is forced perpendicular to the axis of the teeth configured in inner surface 312, the detent element of detent assembly 310 can be compressed inward by sliding toward the tip of a tooth 314 as the detent element is forced up the slope of a first tooth and over the tip of the first tooth 314 and down into a groove 316 separating the first tooth 314 and a second tooth 314. The detent element can then be pushed by the spring bias of the detent assembly 310 into and to engage with the groove 316. In some implementations, this action can result in an audible and/or tactile "click" (or other sound/feel) to provide a user with feedback that a particular rotational distance/setting has been achieved and to provide rotational resistance to preserve an adjustment unless a substantially intentional action is taken to change the adjustment. For example, each rotational "click" can indicate to an optical scope user that the point-of-aim has been adjusted by a particular amount. In other implementations, the detent assembly 310 can be configured into inner surface 312 (with no teeth configured into inner surface 312) and the surface of threaded component 302 can be configured with teeth as described above to provide graduated auditory/tactile feedback. In some implementations, more than one detent assembly 310 (for example, two detent assemblies 310 can be used as a pair) can be configured as part of scope adjustment mechanism 300. Although a detent assembly similar to the detent assembly 310 of FIGS. 3A, 3B, and 4 is also illustrated in FIGS. 6-13, other detent assemblies and mechanisms (e.g., see FIGS. 14A-14D, 15A-15C, and 16A-16B) are permissible and the illustrated assemblies are not intended to be limited only to the described and/or illustrated implementations in the applicable figures.

In some implementations, the adjustment mechanism 300 is actuated by knobs or screws that may be turned with either fingers or with a screwdriver or coin. In the case of optical scopes that adjust a point-of-impact by means of a knob or knobs, a calibrated scale may be included on the knob that allows the user to make precise and visually recognizable changes to the setting of the adjustment mechanism 300. The calibrated scale of the knob may be set with respect to an index mark on the non-rotating surface of the adjustment mechanism 300 or telescope body that indicates the particular adjustment setting.

Marksmen typically "zero" their optical scopes such that a particular or convenient setting on the knob corresponds with a convergence of the point-of-aim and the point-of-impact of the projectile at a chosen distance to the target. Once the optical scope is adjusted such that the point-of-aim corresponds to the point-of-impact at the desired distance to the target, there needs to be a way to rotationally adjust the calibrated knob with respect the index mark without changes to the point-of-aim—point-of-impact relationship. This process is commonly known as zeroing or re-zeroing. During this zeroing or re-zeroing process, the knob must be free to rotate without transmitting torque to the adjustment mechanism such that rotation of the knob does not result in translation or movement of the erector tube. Once the zeroing or re-zeroing adjustment setting is chosen, the knob must be locked or fixed to the adjustment mechanism such that further rotation of the knob will result a translation of torque to the adjustment mechanism that will in turn result in changes to the point-of-impact. Transfer of torque from the knob to the actuation mechanism is typically performed by means of axial set screws or some other mechanism that requires the use of tools.

Figure 5B:
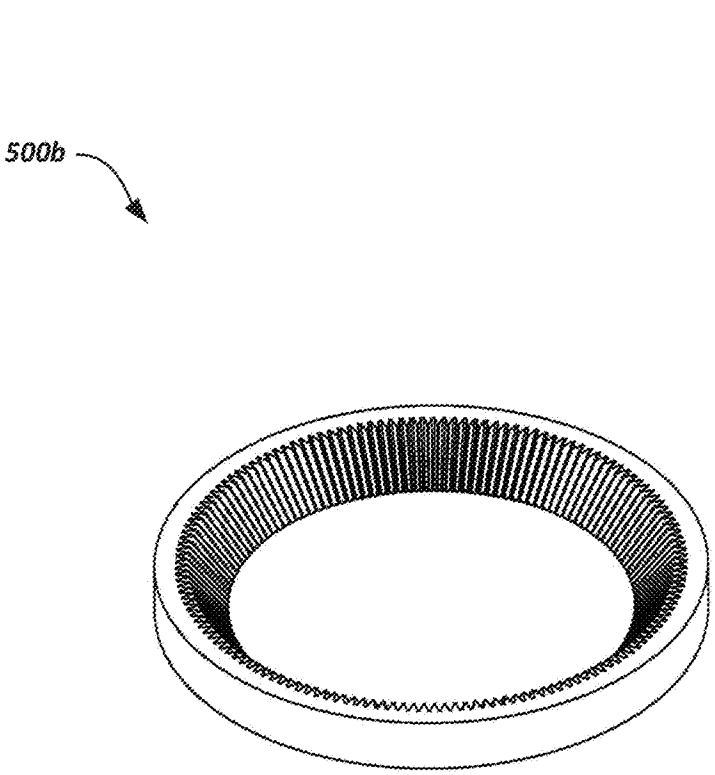
FIGS. 5A and 5B illustrate perspective views of example male and female conical splines according to an implementation.
Figure 5A:
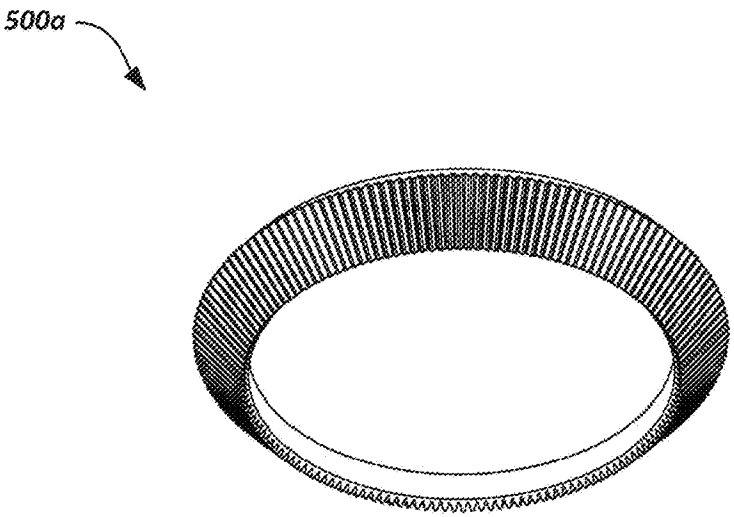

The present disclosure also pertains to a mechanism for a scope configured to transfer torque between the knob and the adjustment mechanism, the structure configured to effectuate the torque coupling and uncoupling, and mechanisms/structures to provide auditory/tactile feedback while adjusting an optical scope. In some implementations, two mechanical surfaces, engaged axially, are configured such that rotational movement with respect to one another is prevented or highly resisted when the surfaces are in contact with one another under a small amount of axial force. The axial force may be applied or released through the rotation of a screw or knob that may be tightened or loosened with finger pressure only and which does not require the use of a tool of any kind. In some implementations, the engagement height of the corresponding surfaces is low such that the surfaces engage and disengage with a minimal axial movement of the components with respect to one another. The two surfaces that when coupled transmit torque may be arranged in multiple different configurations (e.g., flat, conical, and/or other configurations). In some implementations, the two surfaces may transmit torque through a series of mating teeth and/or other structure(s). In some implementations, the two surfaces may be beveled or conical splines that transmit torque through a series of mating teeth when coupled together. For example, FIGS. 5A and 5B illustrate side perspective views 500*a* and 500*b*, respectively, of example male and female conical splines according to such an implementation. In some implementations, the two surfaces may be close-fitting tapered or conical smooth surfaces that transmit torque through friction, similar in concept to those commonly used in tool holders for machine tools. The two surfaces may also be flat high-friction surfaces that transmit torque rather that rotate with respect to one another.

Figure 6:
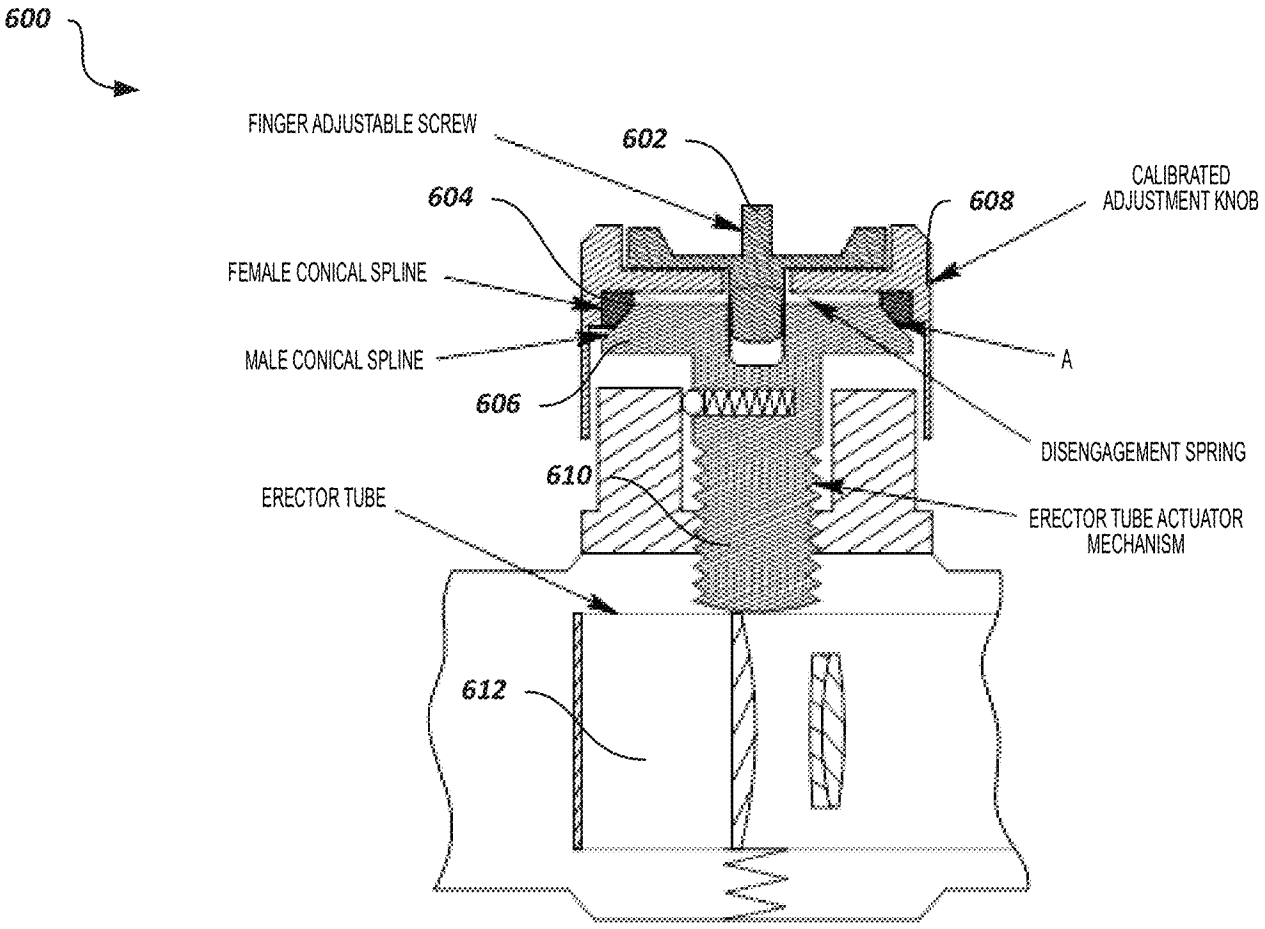
FIG. 6 illustrates a scope adjustment mechanism including conical splines shown in the engaged position according to an implementation.

FIG. 6 illustrates a scope adjustment mechanism 600 including conical splines shown in the engaged position according to an implementation. In FIG. 6 an illustration of a scope adjustment mechanism 600 including a finger-adjustable screw 602, a female conical spline 604 attached to the finger-adjustable screw 602, and a male conical spline 606 is shown. In FIG. 6, the female conical spline 604 is shown engaged with the male conical spline 606 (note the engagement at position A in the figure). In the depicted scenario, the finger-adjustable screw 602 has been tightened to apply axial force on the female conical spline 604 to cause it to engage with the male conical spline 606. In such a configuration, a rotation of the calibrated adjustment knob 608 will cause a rotation of the erector tube actuator 610. The erector tube actuator 610 will exert downward force on the erector tube 612, thus changing the position of the erector tube.

Figure 7:
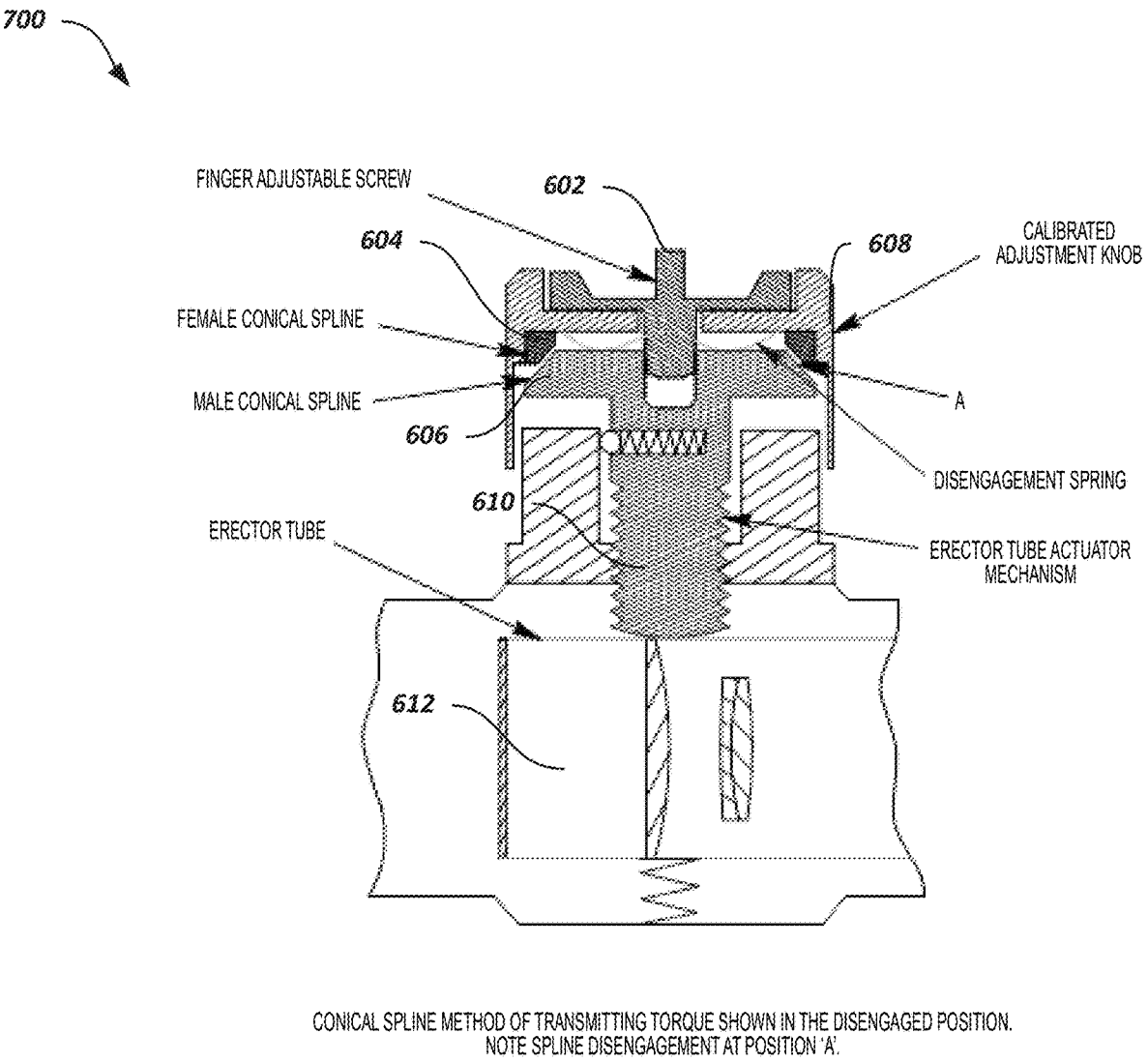
FIG. 7 illustrates a scope adjustment mechanism including conical splines shown in the disengaged position according to an implementation.

FIG. 7 illustrates a scope adjustment mechanism 700 including conical splines shown in the disengaged position according to an implementation. In FIG. 7, the female conical spline 604 is shown disengaged with the male conical spline 606 (note the engagement at position A in the figure). In the depicted scenario, the finger-adjustable screw 602 has been loosened so that it is not applying axial force on the female conical spline 604. In such a configuration, a rotation of the calibrated adjustment knob 608 will not cause a rotation of the erector tube actuator 610.

Figure 8:
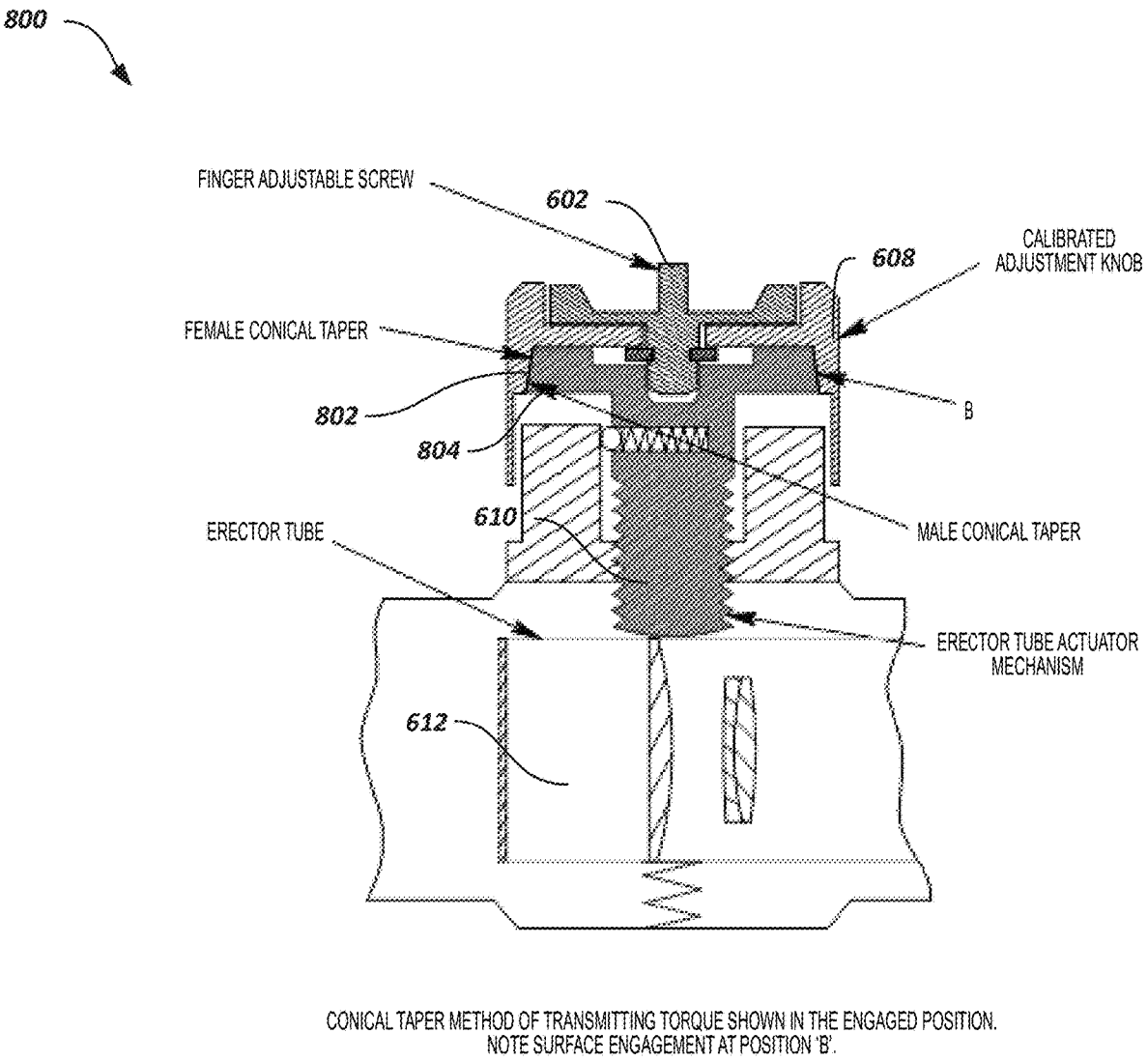
FIG. 8 illustrates a scope adjustment mechanism including conical tapers shown in the engaged position according to an implementation.

FIG. 8 illustrates a scope adjustment mechanism 800 including conical tapers shown in the engaged position according to an implementation. The scope adjustment mechanism 800 is similar to the scope adjustment mechanism 600 except that the scope adjustment mechanism 800 includes female and male conical tapers 802 and 804 in place of the female and male conical splines 604 and 606.

The scope adjustment mechanism 800 includes a finger-adjustable screw 602, a female conical taper 802 attached to the finger-adjustable screw 602, and a male conical taper 804. In FIG. 8, the female conical taper 802, as part of 608 is shown engaged with the male conical taper 804 (note the engagement at position B in the figure). In the depicted scenario, the finger-adjustable screw 602 has been tightened to apply axial force on the female conical taper 802 to cause it to engage with the male conical taper 804. In such a configuration, a rotation of the calibrated adjustment knob 608 will cause a rotation of the erector tube actuator 610. The erector tube actuator 610 will exert downward force on the erector tube 612, thus changing the position of the erector tube.

Figure 9:
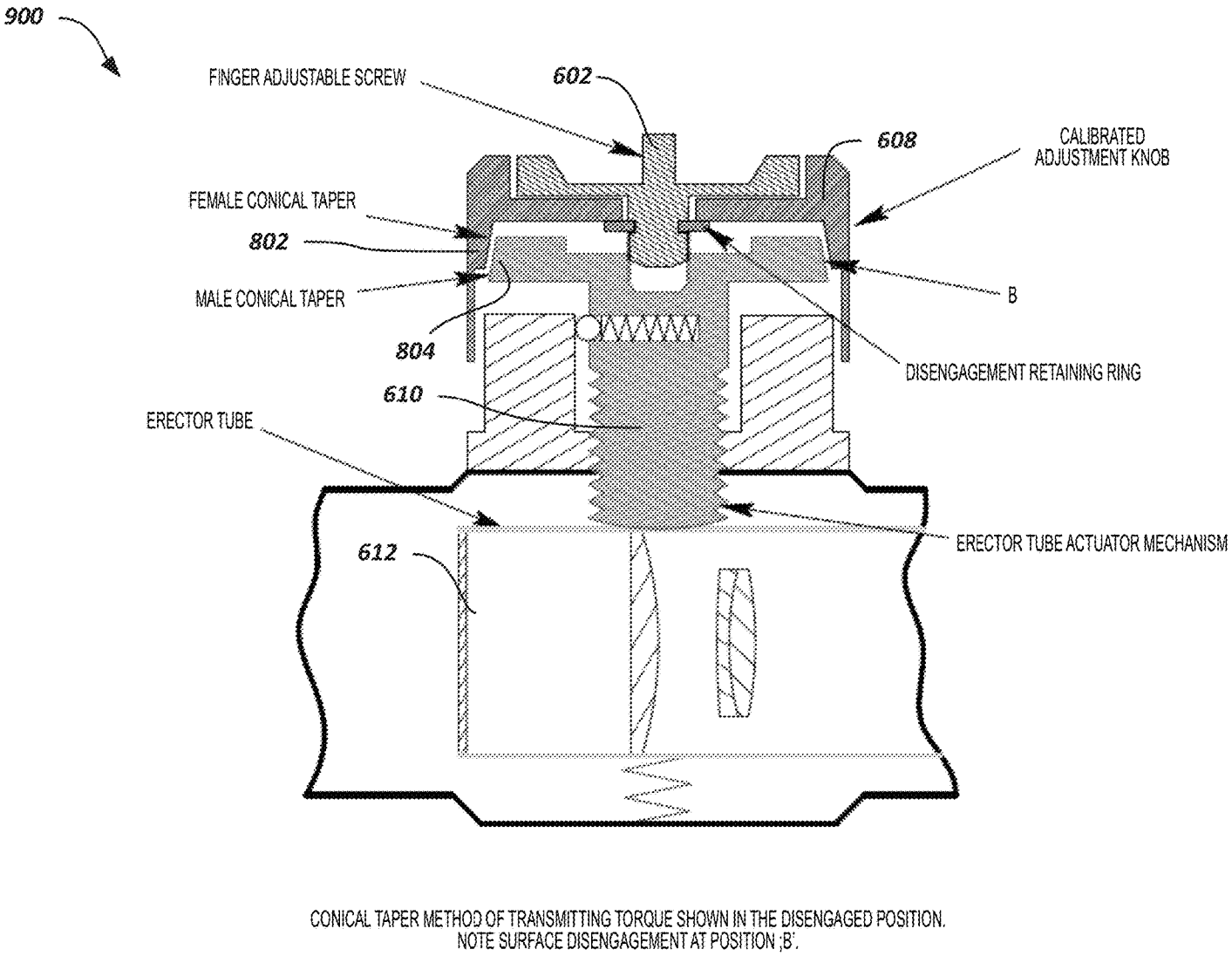
FIG. 9 illustrates a scope adjustment mechanism including conical tapers shown in the disengaged position according to an implementation.

FIG. 9 illustrates a scope adjustment mechanism 900 including conical tapers shown in the disengaged position according to an implementation. In FIG. 9, the female conical taper 802, as part of 608, is shown disengaged with the male conical taper 804 (note the disengagement at position B in the figure). In some implementations, a small space will exist between the female conical taper 802 and the male conical taper 804. In the depicted scenario, the finger-adjustable screw 602 has been loosened so that it is not applying axial force on the female conical taper 802. In such a configuration, a rotation of the calibrated adjustment knob 608 will not cause a rotation of the erector tube actuator 610.

Figure 10:
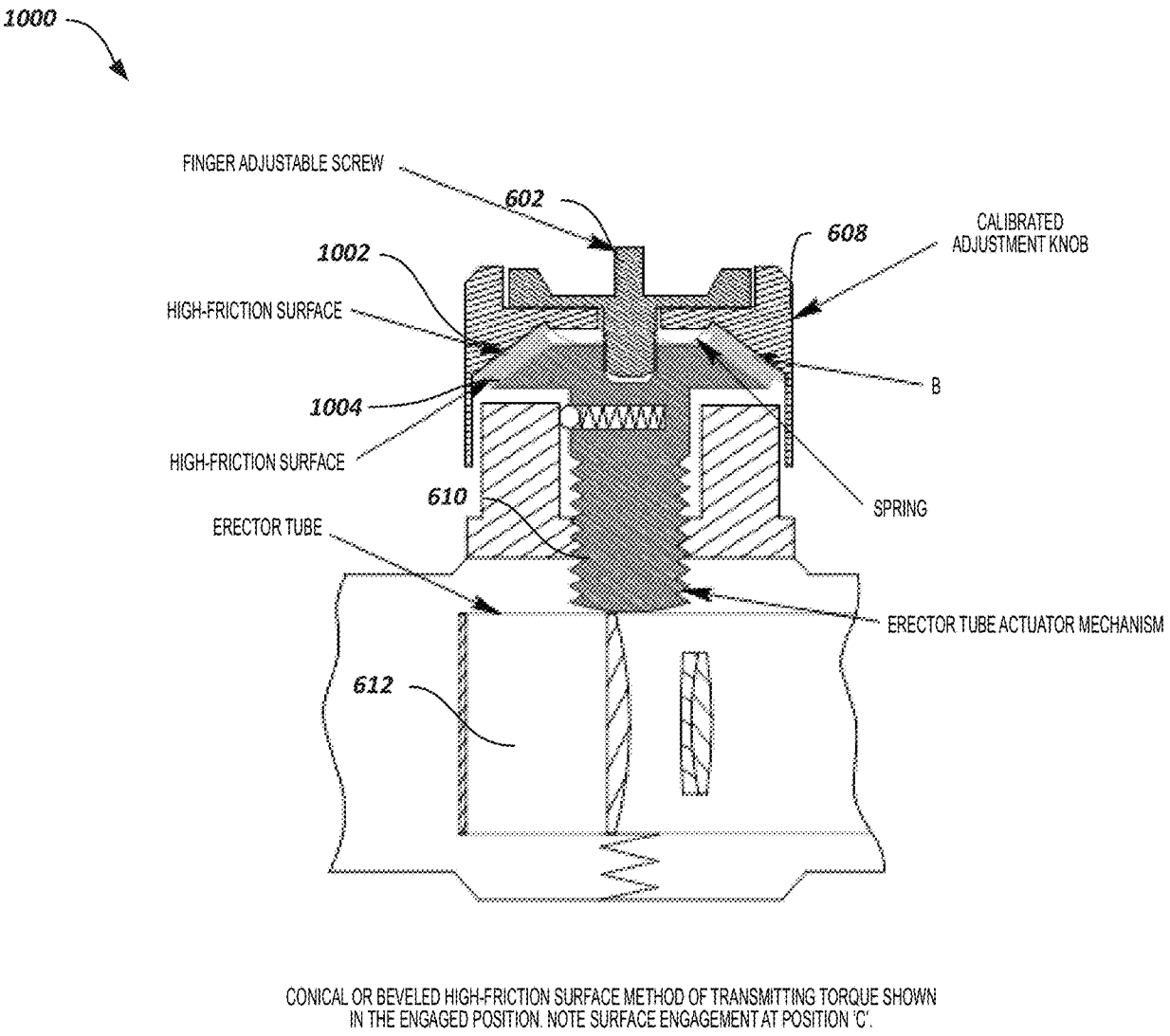
FIG. 10 illustrates a scope adjustment mechanism including conical or beveled high friction surfaces shown in the engaged position according to an implementation.

FIG. 10 illustrates a scope adjustment mechanism 1000 including conical or beveled high friction surfaces shown in the engaged position according to an implementation. The scope adjustment mechanism 1000 is similar to the scope adjustment mechanism 600 except that the scope adjustment mechanism 1000 includes two conical or beveled high friction surfaces 1002 and 1004 in place of the female and male conical splines 604 and 606.

The scope adjustment mechanism 1000 includes a finger-adjustable screw 602, a high friction surface 1002 attached to the finger-adjustable screw 602, and a high friction surface 1004. In FIG. 8, the high friction surface 1002 is shown engaged with the high friction surface 1004 (note the engagement at position C in the figure). In the depicted scenario, the finger-adjustable screw 602 has been tightened to apply axial force on the high friction surface 1002 to cause it to engage with the high friction surface 1004. In such a configuration, a rotation of the calibrated adjustment knob 608 will cause a rotation of the erector tube actuator 610. The erector tube actuator 610 will exert downward force on the erector tube 612, thus changing the position of the erector tube.

Figure 11:
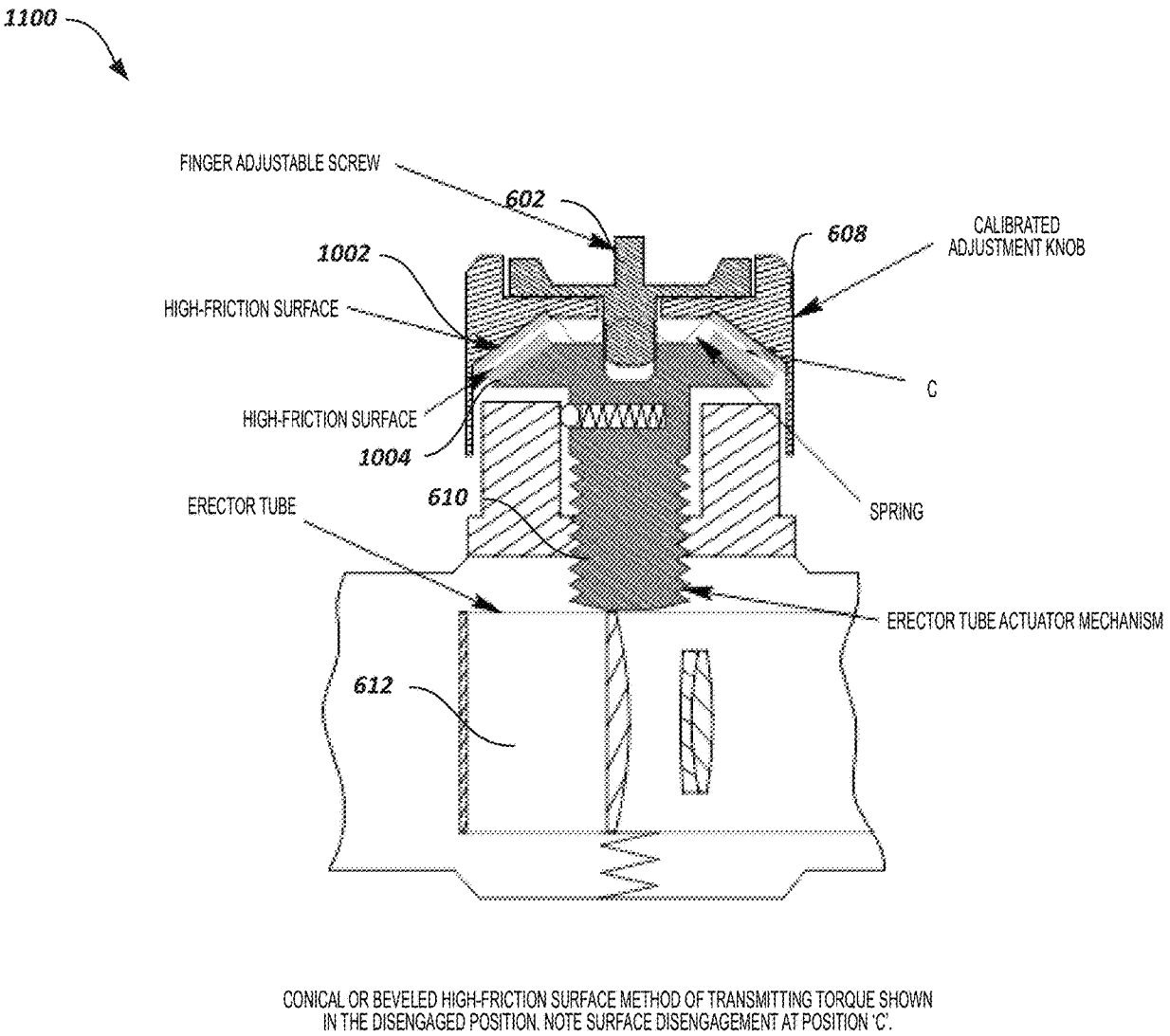
FIG. 11 illustrates a scope adjustment mechanism including conical or beveled high friction surfaces shown in the disengaged position according to an implementation.

FIG. 11 illustrates a scope adjustment mechanism 1100 including conical or beveled high friction surfaces shown in the disengaged position according to an implementation. In FIG. 11, the high friction surface 1002 is shown disengaged with the high friction surface 1004 (note the engagement at position C in the figure). In the depicted scenario, the finger-adjustable screw 602 has been loosened so that it is not applying axial force on the high friction surface 1002. In such a configuration, a rotation of the calibrated adjustment knob 608 will not cause a rotation of the erector tube actuator 610.

Figure 12:
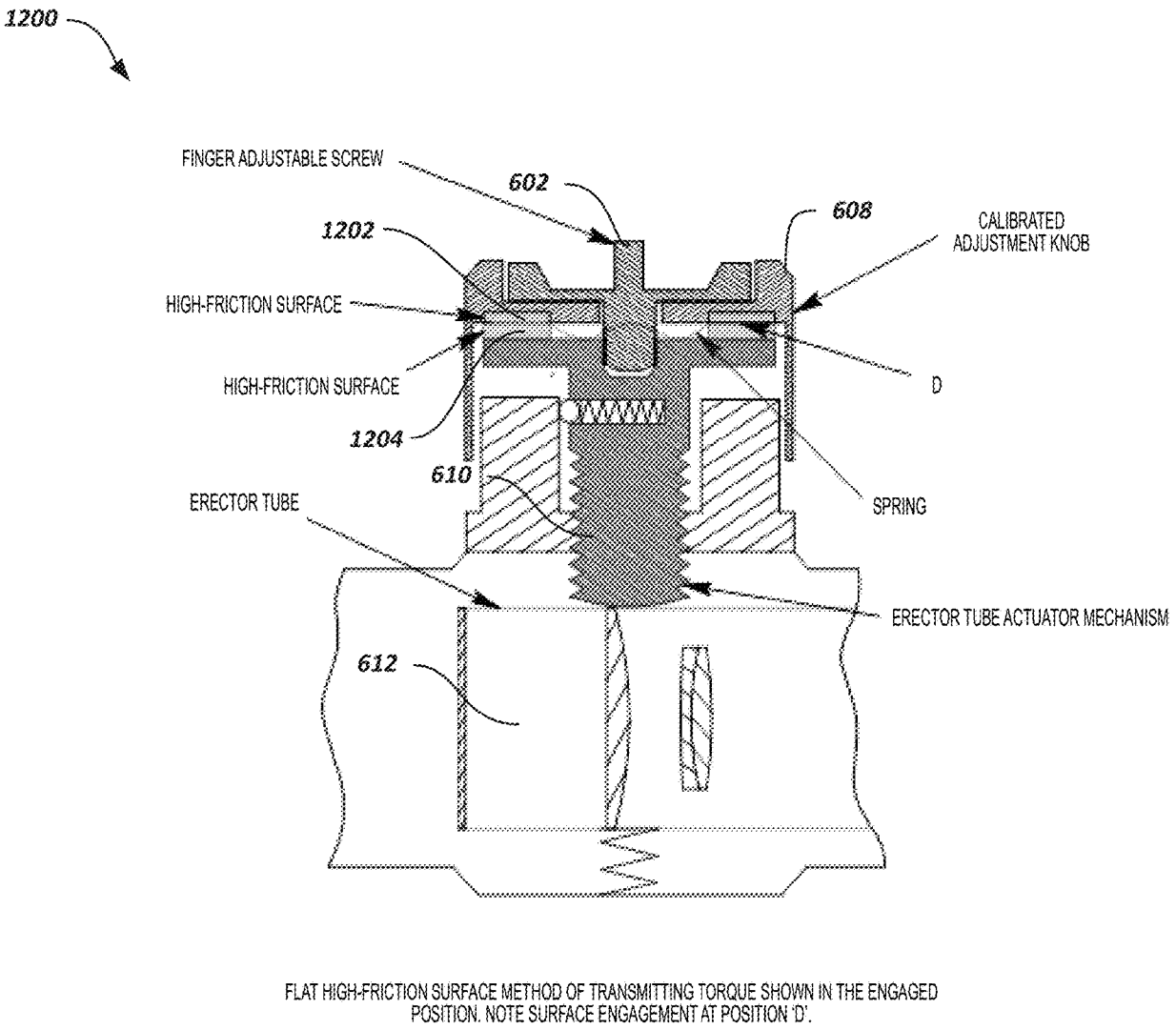
FIG. 12 illustrates a scope adjustment mechanism including flat high friction surfaces shown in the engaged position according to an implementation.

FIG. 12 illustrates a scope adjustment mechanism 1200 including flat high friction surfaces shown in the engaged position according to an implementation. The scope adjustment mechanism 1200 is similar to the scope adjustment mechanism 600 except that the scope adjustment mechanism 1200 includes two flat high friction surfaces 1202 and 1204 in place of the female and male conical splines 604 and 606.

The scope adjustment mechanism 1200 includes a finger-adjustable screw 602, a high friction surface 1202 attached to the calibrated adjustment knob 608, and a high friction surface 1204 attached to 610. In FIG. 12, the high friction surface 1202 is shown engaged with the high friction surface 1204 (note the engagement at position D in the figure). In the depicted scenario, the finger-adjustable screw 602 has been tightened to apply axial force on the high friction surface 1202 to cause it to engage with the high friction surface 1204. In such a configuration, a rotation of the calibrated adjustment knob 608 will cause a rotation of the erector tube actuator 610. The erector tube actuator 610 will exert downward force on the erector tube 612, thus changing the position of the erector tube.

Figure 13:
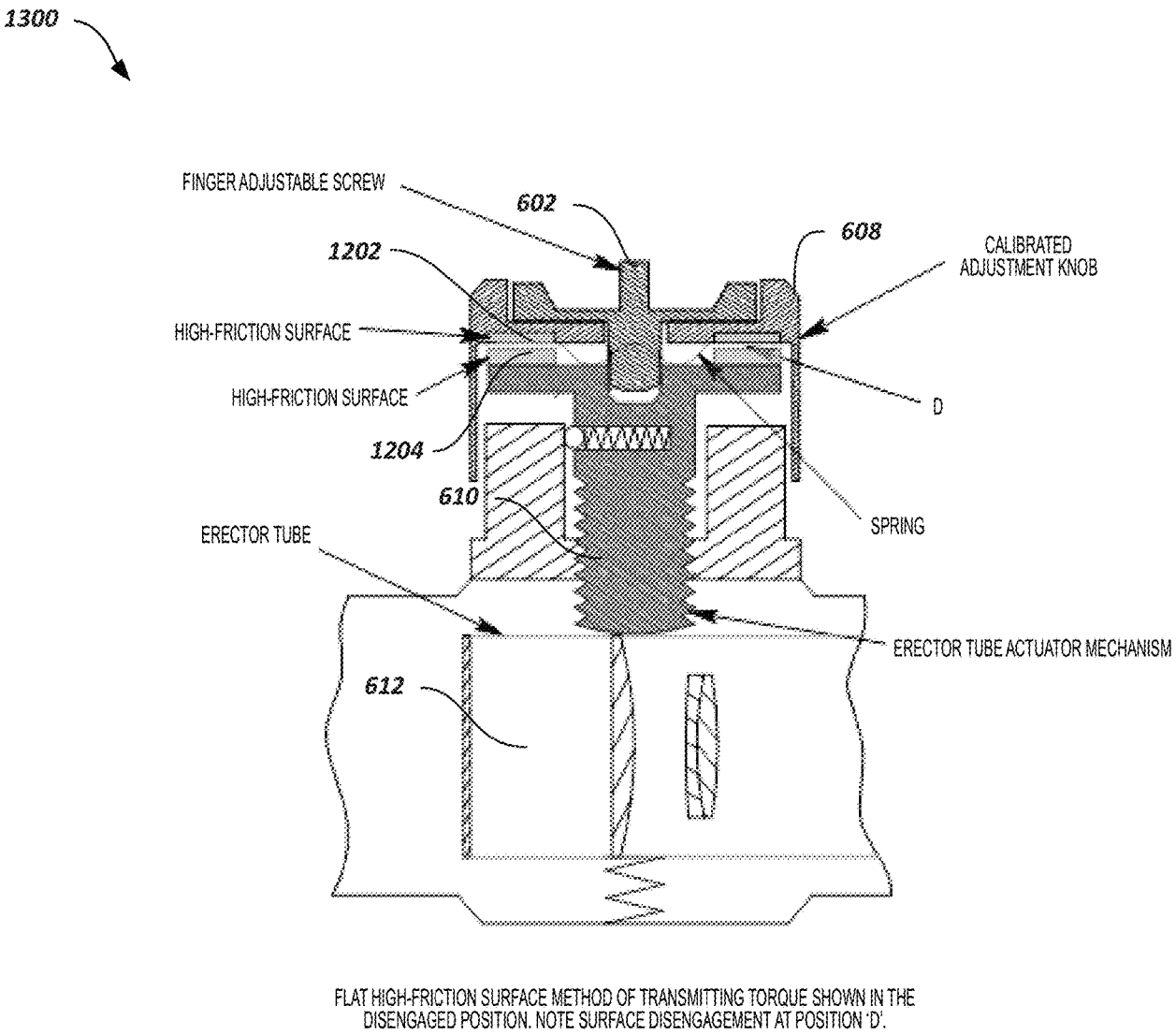
FIG. 13 illustrates a scope adjustment mechanism including flat high friction surfaces shown in the disengaged position according to an implementation.

FIG. 13 illustrates a scope adjustment mechanism including flat high friction surfaces shown in the disengaged position according to an implementation. In FIG. 13, the high friction surface 1202 is shown disengaged with the high friction surface 1204 (note the engagement at position D in the figure). In the depicted scenario, the finger-adjustable screw 602 has been loosened so that it is not applying axial force on the high friction surface 1202. In such a configuration, a rotation of the calibrated adjustment knob 608 will not cause a rotation of the erector tube actuator 610.

Auditory/Tactile Feedback

As graduations associated with the adjustment mechanism described in FIGS. 3A and 3B become finer/narrower (e.g., the size and/or spacing of teeth, spline, etc.), the configuration of the illustrated detent assembly 310 described in the example of FIGS. 3A and 3B can, in some implementations, become impractical. For example, a ball bearing would need to be reduced in size to properly engage example grooves 316 between teeth 314 as illustrated in FIG. 3B if configured to be finer/narrower. As a result, the example coil spring of detent assembly 310 would also need to be reduced in size and, as it became smaller, would become less effective in providing adequate spring bias against the ball bearing to, for example, engage the grooves 316 with enough force to provide resistance to rotating threaded component 302 (or any rotating ring/component of another implementation) and/or to provide adequate auditory/tactile feedback to an optical scope user while adjusting the optical scope. The description below relates to improved detent assemblies and is applicable to any mechanism requiring the described detent functionality. In some implementations, the improved detent assemblies can be incorporated into the previously described structures of FIGS. 1-2, 3A-3C, 4, 5A-5B, and 6-13. In some implementations, more than one described detent assembly can be used simultaneously in conjunction with or in opposition to each other to provide desired operational characteristics such as rotational resistance, graduation precision, auditory/tactile feedback, etc.

With respect to FIGS. 1-2, 3A-3C, 4, 5A-5B, and 6-13, threaded component 302 depicts a rotating mechanism that can be threaded or simply coupled to the erector tube actuation mechanism. Whether 302 is threaded or not, in the case that 302 rotates, inner surface 312 is configured as part of 304 and is fixed such that it does not rotate in relation to 302. In some implementations, this detent mechanism may also be configured whereby 302 is fixed and the inner surface 312 is incorporated in a rotating knob or other part denoted by 304. In some implementations 304 can also be threaded or not threaded. In either case, one part remains fixed in position while the corresponding part or mechanism may be rotated. This feature may be incorporated in the adjustment knob and/or erector actuation mechanism or may be self-contained components that are part of an assembly of the rifle scope or optical sighting system adjustment mechanism. The inner surface 312 can, in some implementations, be configured as part of 302 with the detents as part of 304 (and similar to the description above, with 302 or 304 rotating). In some implementations, with respect to FIGS. 14A-14D, 15A-15C, and 16A-16C, for purposes of understanding, component 1412 can correspond to threaded component 302, component 1414 can correspond to threaded component 304, and inner surface 1416 can correspond to inner surface 312. This correspondence, however, does not imply in any way that limitations of 302, 304, and 312 are necessarily applicable to 1412, 1414, and/or 1416.

Figure 14D:
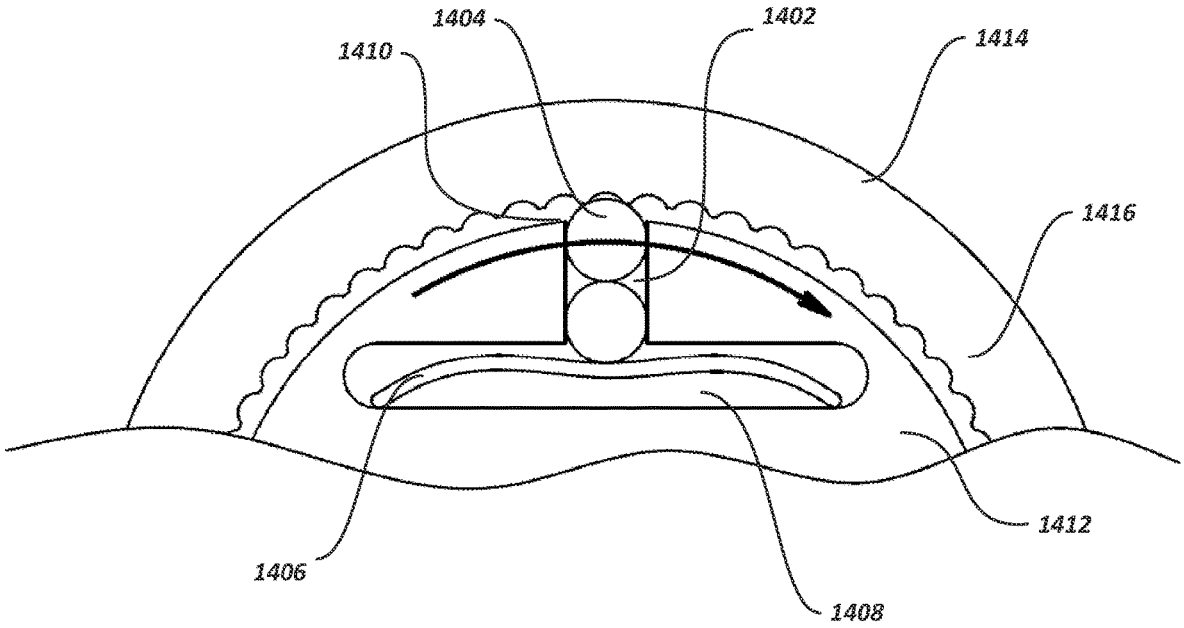

FIG. 14A illustrates a top view of a partial cross section 1400*a* of a first alternate detent assembly to provide tactile feedback according to an implementation. In some implementations, component 1412 is configured with channel 1402 to contain and/or guide a detent element 1404 (e.g., a ball bearing (illustrated), radiused detent element, etc.) that is springily biased toward the outer surface of component 1412 (and toward inner surface 1416 of component 1414) by spring 1406 (e.g., a leaf, flat, wave, or other spring). As illustrated, flat spring 1406 is installed into a pocket 1408 configured into the component 1412 and of a shape to secure flat spring 1406 and to provide spring bias against one or more detent elements 1404. In FIG. 14A, two detent elements 1404 are stacked within channel 1402; the bottommost detent element 1404 making contact with and depressing flat spring 1406 to create spring bias upwards against both detent elements 1404. Note that in some implementations, channel 1402 can be configured in such a way to be captive of detent elements 1404. For example, the outer end 1410 of channel 1402 can be staked, peened, or configured in such a way as to prevent the detent element 1404 from passing through the outer end 1401 of channel 1402 but yet far enough to engage a tooth, spline, hole, cavity, groove, an/or other structure of the inner surface 1416 of component 1414 to provide a detent function. As an example, where the detent elements 1404 are ball bearings, the outer end 1410 of channel 1402 can be of a smaller diameter than the ball bearings. FIGS. 14B, 14C, and 14D illustrate cross sectional views 1400*b*, 1400*c*, and 1400*d*, respectively, of a second, third, and fourth alternate detent assembly to provide auditory/tactile feedback during optical scope adjustment according to an implementation. The descriptions of FIGS. 14B and 14C are similar to that of FIG. 14A except for the shape of the spring 1406, pocket shape 1408, and/or the number of detent element illustrated. In the illustrated examples of FIGS. 14B-14D, springs 1406 are shaped variously shaped flat springs and the shape of pocket 1408 is adjusted according to the shape of the spring 1406. Shapes/materials of spring 1406 and/or the shape of pocket 1408 can be varied to configure the spring bias provided against detent element 1404 by the spring 1406. Any other necessary modifications between illustrated embodiments of FIGS. 14A-14D should, based on the previous description, be apparent to those of ordinary skill in the art.

Figure 15A:
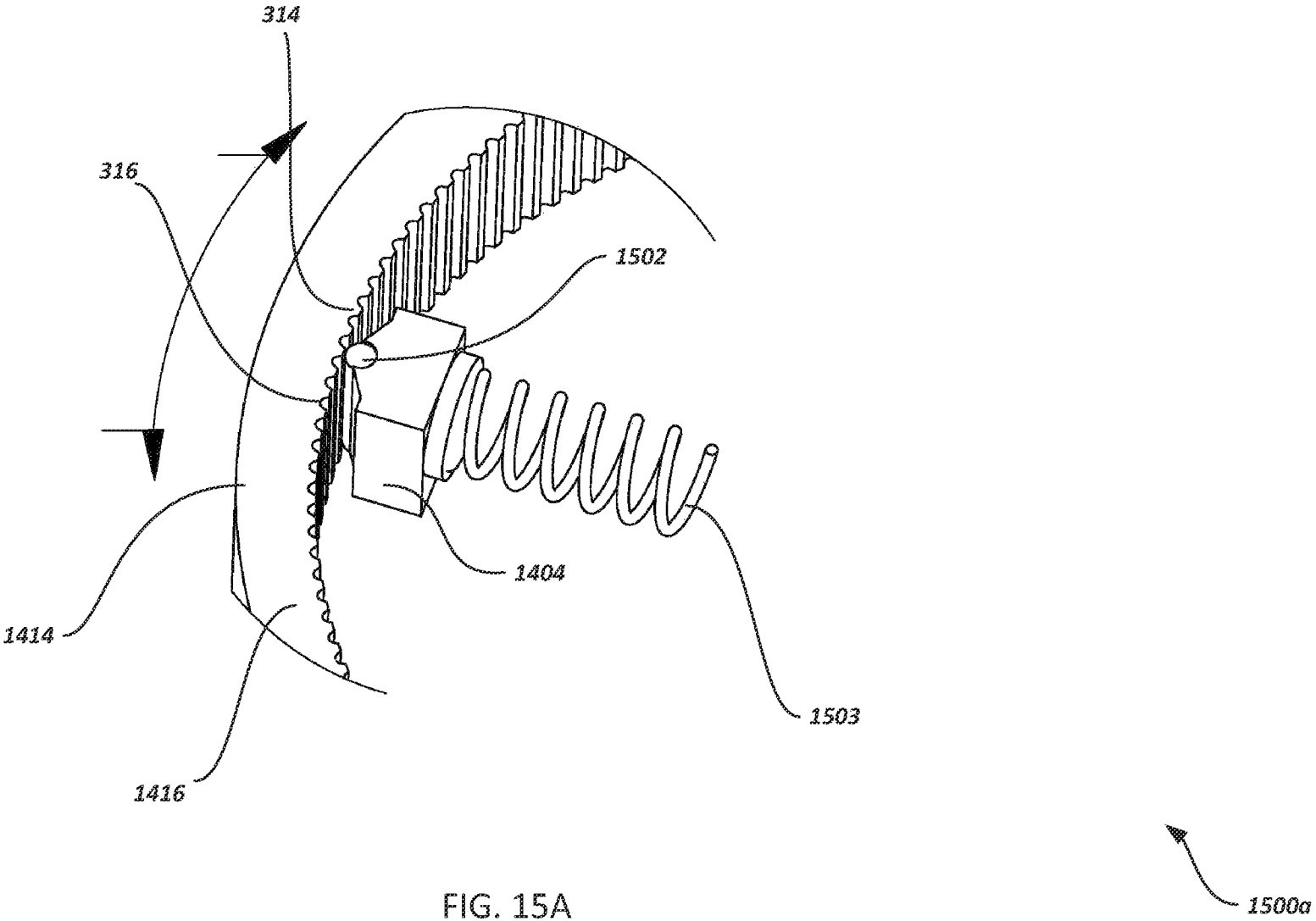
FIG. 15A illustrates a partial perspective view 1500*a* of a detent element with a radiused tip for providing line contact with an engagement surface according to an implementation.

FIG. 15A illustrates a partial perspective view 1500*a* of a detent element 1404 with a radiused tip 1502 for providing line contact with an engagement surface (e.g., a toothed or splined surface) according to an implementation. In the illustrated implementation, the detent element 1404 has a radiused tip 1502 and is springily biased toward inner surface 1416 of component 1414 by spring 1503. Although spring 1503 is illustrated as a coil spring, the use of other types of springs is considered within the scope of this disclosure (e.g., refer to FIGS. 14A-14D). In typical implementations, the radiused tip is cylindrical in shape (with an equal major and minor axis along its length). In other alternative implementations, the radiused tip can have a different value for a major and minor axis along its length (e.g., the radiused tip can form an elliptic cylinder). In some implementations, the major and minor axis values can vary along the length of the radiused tip 1502. Varying the major and/or minor axis of the radiused tip 1502 can be used to configure the detent element 1404 to provide a shallower or deeper engagement with, for example, the groove 316.

Figure 15B:
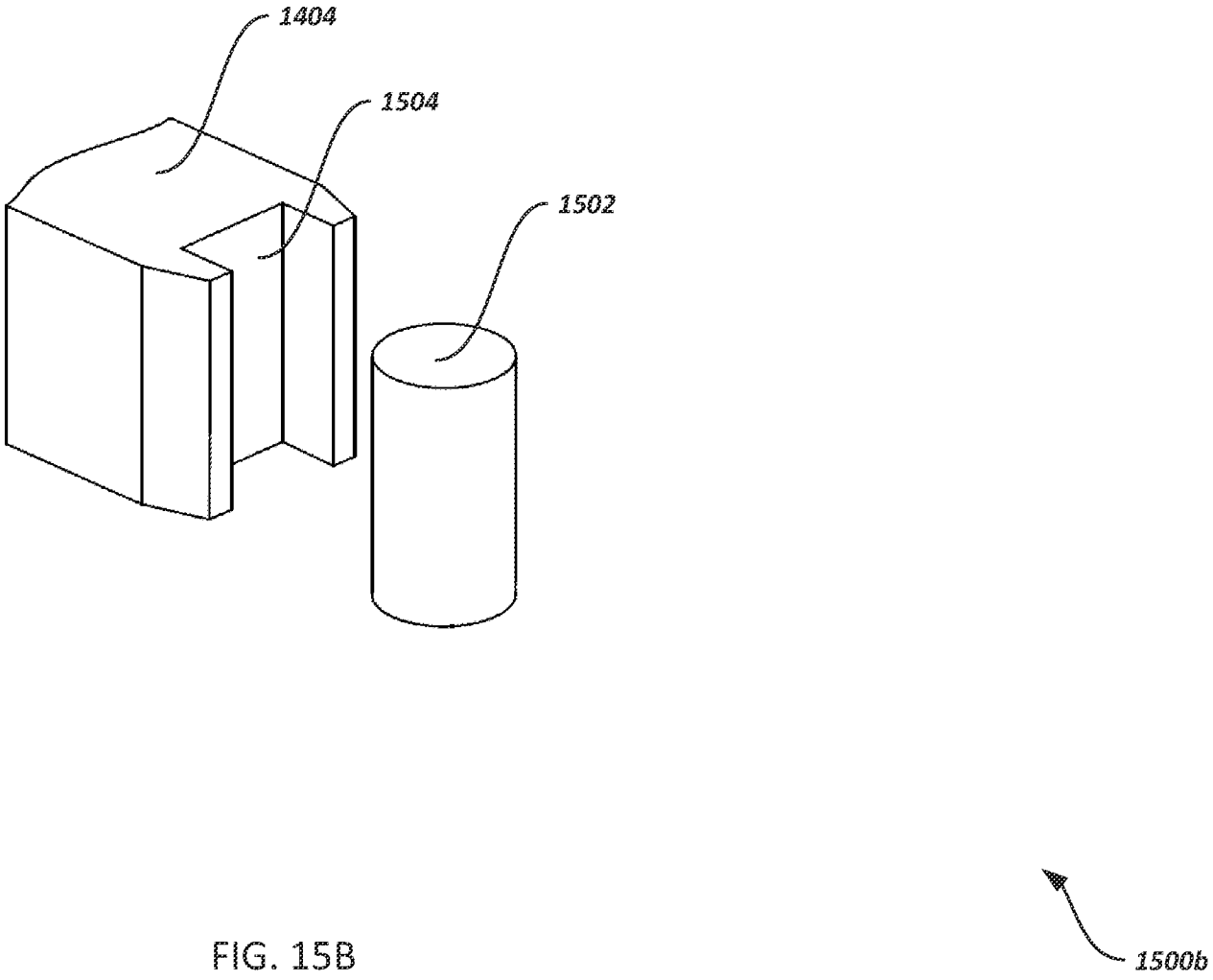
FIG. 15B illustrates a partial perspective view 1500*b* of a detent element configured to couple with a radiused tip for providing line contact with an engagement surface according to an implementation.

In some implementations, the detent element can be configured with a particular radiused tip 1502 (e.g., machined with a particularly shaped radiused tip 1502 as described above). In other implementations, as illustrated in FIG. 15B, the detent element 1404 can be configured to be coupled with a separate radiused tip 1502. FIG. 15B illustrates a perspective view 1500*b* of a detent element 1404 configured to couple with a radiused tip 1502 for providing line contact with an engagement surface according to an implementation. For example, radiused tip 1502 can be a cylindrical, elliptical, or other shaped structure that is coupled (e.g., press fit, adhered, welded, etc.) to detent element 1404 (e.g., into a receiving channel 1504) configured into the detent element 1404 in order to secure the radiused tip 1502 to the detent element 1404 and to allow the radiused tip 1502 to travel with the detent element 1402. Although receiving channel 1504 is illustrated as being cuboid in shape, other configurations are also possible. For example, refer to FIG. 15C which illustrates radiused tip 1502 coupled with detent element 1404 within a cylindrically-shaped receiving channel 1504.

In some implementations, the radiused tip 1502 can be hardened (e.g., machined from a hardened material or the radiused tip 1502 hardened after machining in the case of FIG. 15A) or configured of a hardened material that is coupled with the detent element 1404 (e.g., as in the case of FIG. 15B). In some implementations, hardened material can include steel, ceramic, glass, alloys, coated materials such as a ceramic coated aluminum rod, and other hardened material. As will be appreciated by those of ordinary skill in the art, hardness values can be adjusted based on the hardness of materials (e.g., teeth) to be engaged by the radiused tip 1502. In addition to hardness, the radiused tip 1502 and/or the engagement surfaces (e.g., tooth 314, groove 316, etc.) can be configured with a particular surface roughness value to affect tactile sensations provided as the radiused tip 1502 bears against the engagement surfaces.

Figure 15C:
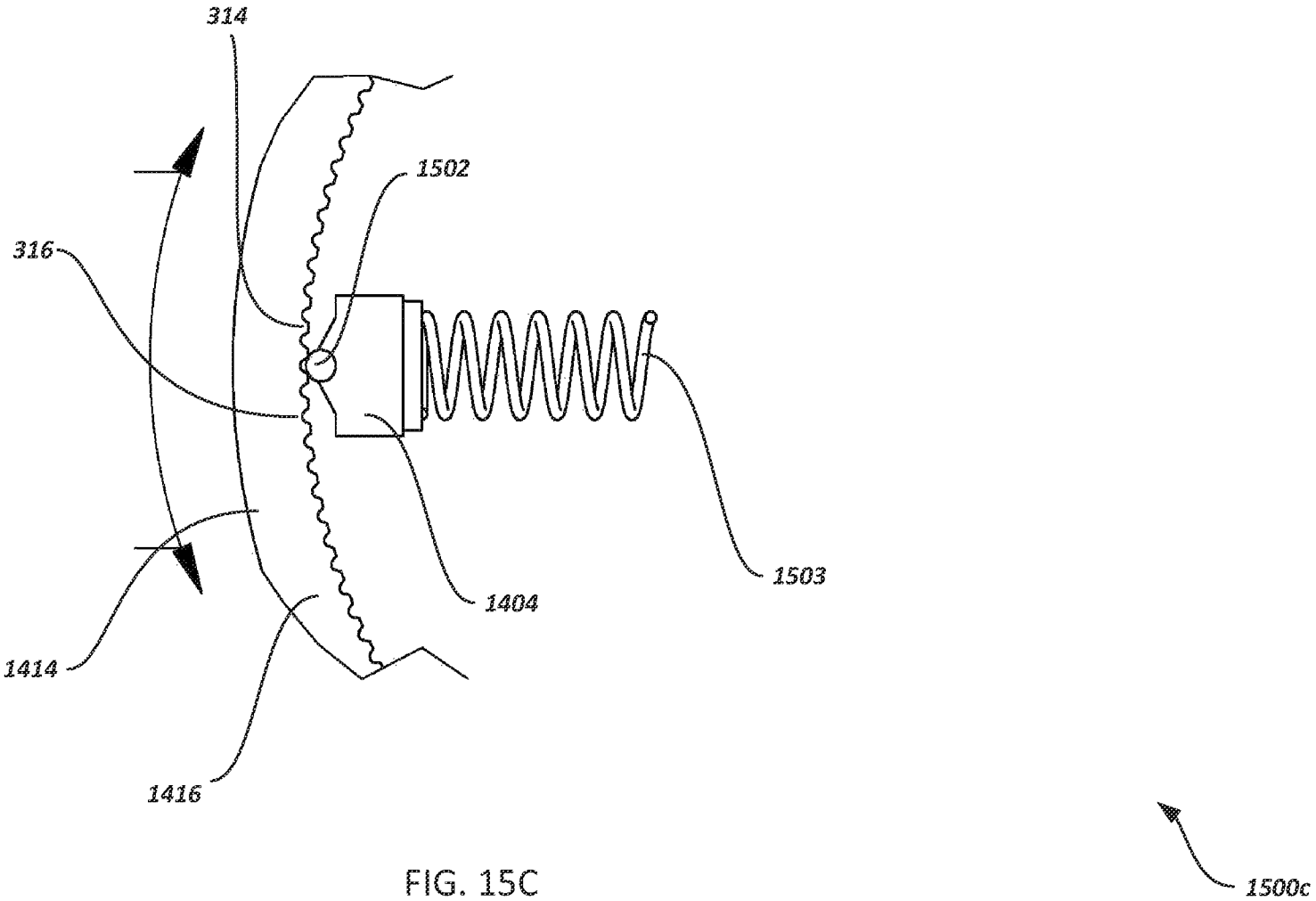
FIG. 15C illustrates a top, partial perspective view 1500*c* of a detent element 1404 coupled with a radiused tip 502 for providing line contact with an engagement surface according to an implementation.

Referring to FIG. 15A, the radiused tip 1502 provides, among other things, a consistent engagement between the detent element/radiused tip and, for example, teeth 314/grooves 316. The radiused edge of the radiused tip 1502 not only bears more easily against an engagement surface, the radiused tip 1502 provides a consistent line contact with engagement surfaces that is not provided by a ball bearing or non-linear detent element. For example, as illustrated in FIG. 15A, the entire axial length of radiused tip 1502 would make contact with corresponding engagement surfaces associated with tooth 314 and groove 316, providing much more contact surface area. This is in contrast to a sphere-shaped detent element 1404 (e.g., a ball bearing as in FIG. 3B). A ball bearing would provide a point-type contact with much less surface area of the ball bearing making contact with a correspondingly reduced surface area of the same engagement surfaces. As a result, wear on a radiused tip 1502 and associated engagement surfaces is reduced and/or distributed more evenly along the surface area of the engagement surfaces; increasing the useful life of both the detent element and the engagement surfaces. In contrast, a ball bearing used as a detent element 1404 can result in a localized zone of wear along the described engagement surfaces (e.g., at the points of contact the ball bearing makes on the engagement surfaces). FIG. 15C illustrates a top, partial perspective view 1500*c* of a detent element 1404 coupled with a radiused tip 1502 for providing line contact with an engagement surface according to an implementation.

Figure 16A:
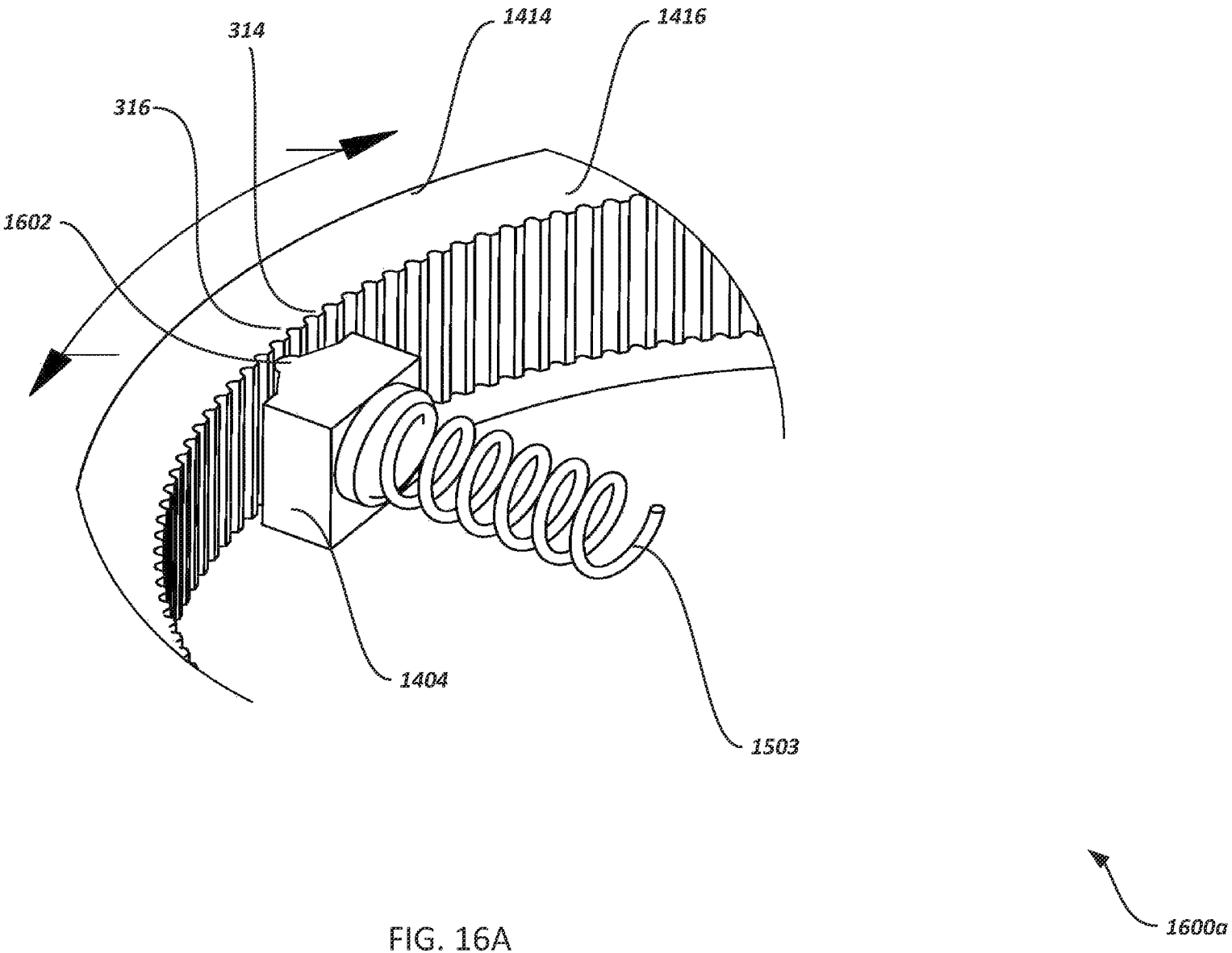
FIG. 16A illustrates a cross-sectional view of an alternate detent element according to an implementation.
Figure 16B:
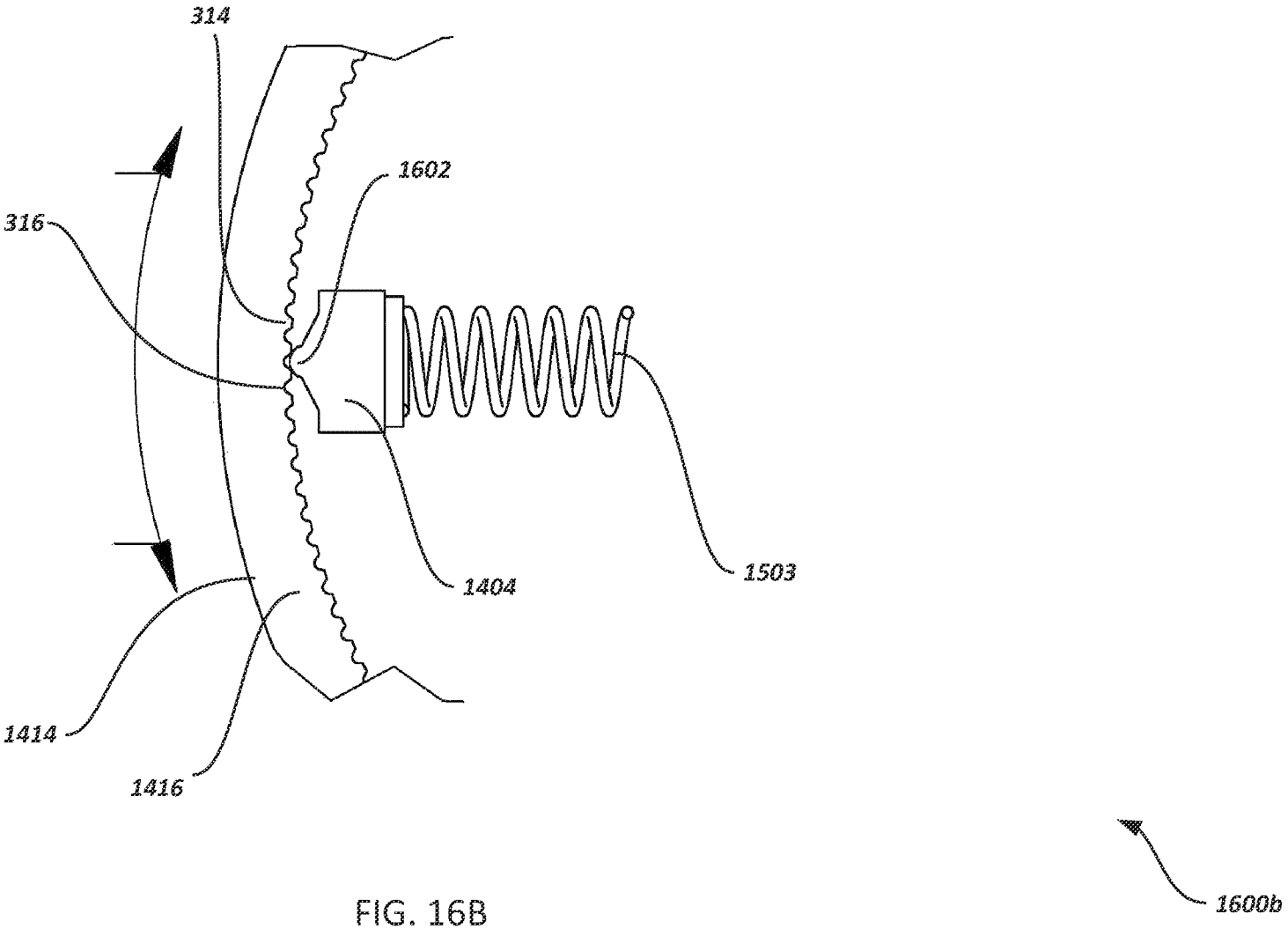
FIG. 16B illustrates a top, partial cross-sectional view of the alternate detent element of FIG. 16A according to an implementation.
Figure 16C:
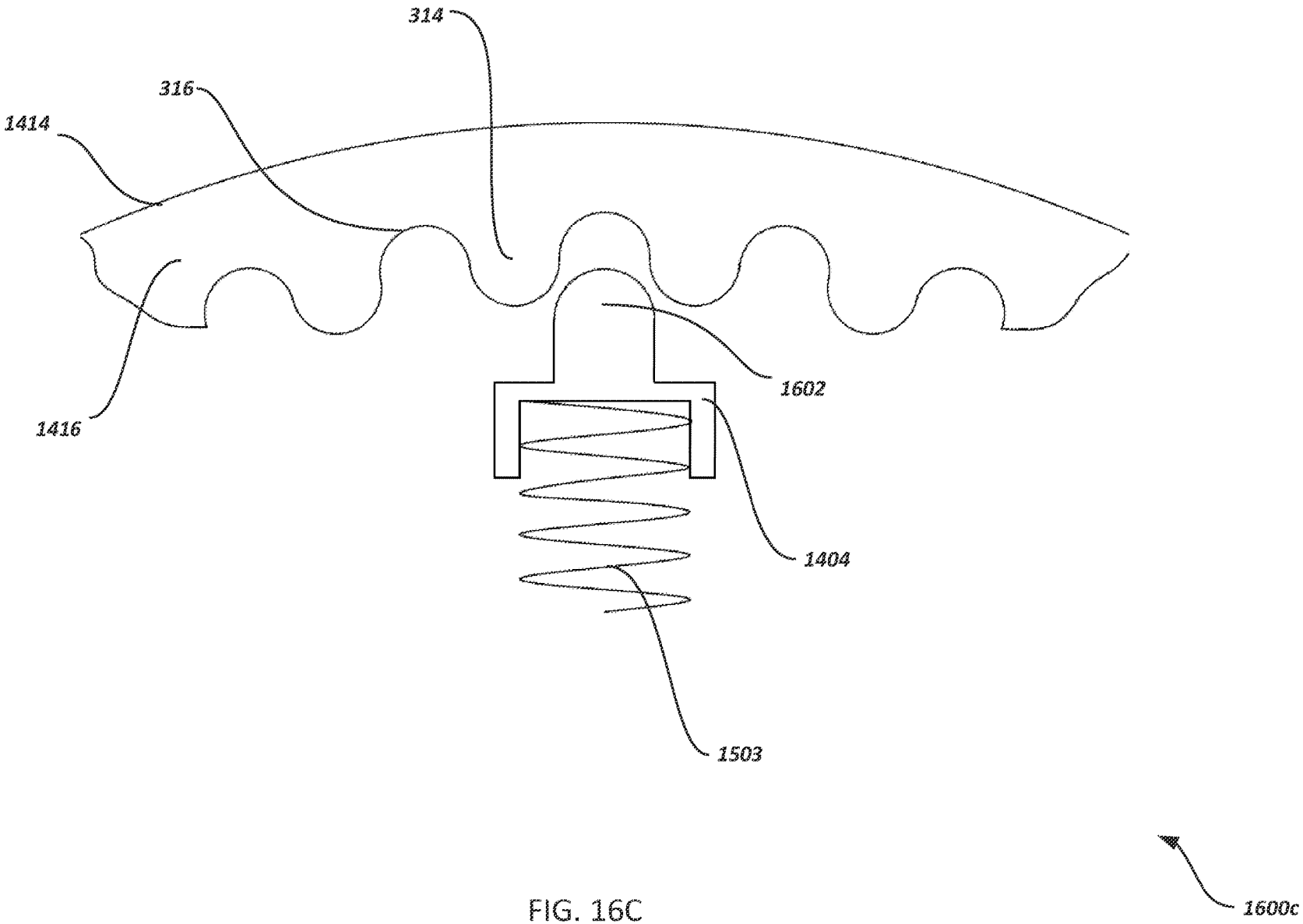
FIG. 16C illustrates a top, partial cross-sectional view of another alternate detent element according to an implementation.

FIG. 16A illustrates a cross-sectional view 1600*a* of an alternate detent element 1404 according to an implementation. The alternate detent element 1404 is configured with a radiused tip engagement surface 1602 without the need to couple a separate radiused tip 1502 to the alternate detent element 1404. In these implementations, the entire alternate detent element 1404 can be configured of a hardened material, hardened after manufacturing (e.g., heat treated, coated with a separate material, etc.), or the radiused tip engagement surface 1602 can be separately hardened (e.g., heat treated, coated with a separate material, etc.) apart from the remainder of the alternate detent element 1404 body. FIG. 16B illustrates a top, partial cross-sectional view of the alternate detent element of FIG. 16A according to an implementation.

Although not illustrated, other configurations of the toothed surface 1416 consistent with this disclosure are also possible. For example, in some implementations, teeth 314 can be configured as rounded in contrast to the illustrated flat surface on teeth 314 in FIG. 16A. In other configurations, the detent element 1404 can be wedge/chisel shaped with teeth 314 in the above-described rounded configuration. In still other implementations, both the detent element 1404 can have a radiused tip (e.g., either a coupled radiused tip 1502 or an integral engagement surface 1602) and the teeth 314 can be rounded as described above (refer to FIG. 16C for an example where FIG. 16C illustrates a top, partial cross-sectional view of another alternate detent element according to an implementation).

In other implementations, the improved detent assembly can be configured into inner surface 1416 (e.g., with no teeth configured into inner surface 1416) and the surface of component 1412 can be configured with teeth as described above to provide graduated auditory/tactile feedback. In some implementations, more than one improved detent assembly can be configured as part of an applicable mechanism.

The figures and accompanying description illustrate example techniques, components, and configurations. This disclosure contemplates using or implementing any suitable method for performing, producing, configuring, or utilizing these and other components. It will be understood that the figures are for illustration purposes only. In addition, many of the features or tasks involving components in these embodiments may take place relatively simultaneously and/or in different configurations than as shown. In short, although this disclosure has been described in terms of certain embodiments and generally associated methods, alterations and permutations of these embodiments and methods will be apparent to those skilled in the art.

Accordingly, the above description of example embodiments does not define or constrain the disclosure. Other changes, substitutions, and alterations are also possible without departing from the spirit and scope of this disclosure, and such changes, substitutions, and alterations may be included within the scope of the disclosure and the claims.

What is claimed is:

1. An adjustment mechanism for a scope comprising:

a first surface and a second surface of a torque transfer system, wherein the first surface and the second surface are mating conical splines, wherein the first surface mechanically engages the second surface axially when an amount of downward axial force is applied to the first surface, and wherein the first surface transfers torque applied to the first surface to the second surface to cause the second surface to rotate when the first surface and the second surface are mechanically engaged; and a member coupled with the first surface and used to apply the amount of downward axial force and torque to the first surface by operation of human fingers, wherein the downward axial force causes mechanical engagement of the first surface and the second surface, and wherein the torque is transferred from the first surface to the second surface.

2. The adjustment mechanism of claim 1, wherein the member is one of a fluted knob, a knurled knob, a wing nut, or a set screw.

3. The adjustment mechanism of claim 1, wherein the member is rotatable in a first direction causing it to exert more force on the first surface, and rotatable in a second direction opposite from the first direction causing it to exert less force on the first surface.

4. The adjustment mechanism of claim 1, wherein the first surface is a female conical spline and the second surface is a male conical spline or the first surface is a male conical spline and the second surface is a female conical spline.

5. The adjustment mechanism of claim 1, wherein the member transmits the downward axial force directly from the human fingers to the first surface.

6. The adjustment mechanism of claim 1, wherein the interaction of the first and second surfaces provides movement of a reticle on an image that is created by the scope.

7. A scope comprising:

a tube;

an objective system;

an ocular system; and an erector system comprising an adjustment mechanism connected to the tube such that the adjustment mechanism provides movement of a reticle on an image that is created by the objective system, the adjustment mechanism including:

a first surface and a second surface of a torque transfer system, wherein the first surface and the second surface are mating conical splines, wherein the first surface mechanically engages the second surface axially when an amount of downward axial force is applied to the first surface, and wherein the first surface transfers torque applied to the first surface to the second surface to cause the second surface to rotate when the first surface and the second surface are mechanically engaged; and a member coupled with the first surface and used to apply the amount of downward axial force and torque to the first surface by operation of human fingers, wherein the downward axial force causes mechanical engagement of the first surface and the second surface, and wherein the torque is transferred from the first surface to the second surface.

8. The scope of claim 7, wherein the member is one of a fluted knob, a knurled knob, a wing nut, or a set screw.

9. The scope of claim 7, wherein the member is rotatable in a first direction causing it to exert more force on the first surface, and rotatable in a second direction opposite from the first direction causing it to exert less force on the first surface.

10. The scope of claim 7, wherein the first surface is a female conical spline and the second surface is a male conical spline or the first surface is a male conical spline and the second surface is a female conical spline.

11. The scope of claim 7, wherein the member transmits the downward axial force directly from the one or more human fingers to the first surface.

* * * * *